US012115436B2

(12) United States Patent
Wittman

(10) Patent No.: US 12,115,436 B2
(45) **Date of Patent: *Oct. 15, 2024**

(54) FIGHT GLOVE

(71) Applicant: XON Sports, Inc., Boulder, CO (US)

(72) Inventor: Trevor Gene Wittman, Golden, CO (US)

(73) Assignee: XON Sports, Inc., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/741,973

(22) Filed: May 11, 2022

(65) Prior Publication Data

US 2022/0401816 A1 Dec. 22, 2022

Related U.S. Application Data

(63) Continuation of application No. 17/223,205, filed on Apr. 6, 2021, now Pat. No. 11,344,788.

(51) Int. Cl.

| | |
|---|---|
| ***A63B 71/14*** | (2006.01) |
| *A41D 13/08* | (2006.01) |
| *A41D 19/015* | (2006.01) |

(52) U.S. Cl.

CPC ..... *A63B 71/145* (2013.01); *A41D 13/08* (2013.01); *A41D 13/081* (2013.01); *A41D 13/082* (2013.01); *A41D 13/084* (2013.01); *A41D 19/01582* (2013.01); *A41D 19/01588* (2013.01); *A63B 71/14* (2013.01); *A63B 2244/102* (2013.01)

(58) Field of Classification Search

CPC .... A41D 13/08; A41D 13/081; A41D 13/082; A41D 13/084; A41D 19/01582; A41D 19/01588; A63B 71/145; A63B 71/14; A63B 2244/102

USPC ..... 2/18

See application file for complete search history.

(56) References Cited

U.S. PATENT DOCUMENTS

| | | | | |
|---|---|---|---|---|
| 5,373,585 | A * | 12/1994 | Wiggins | A63B 21/4019 2/163 |
| 5,802,614 | A * | 9/1998 | Melone, Jr. | A41D 19/01576 2/161.4 |
| 10,376,770 | B2 * | 8/2019 | Wittman | A63B 71/145 |
| 10,729,192 | B2 * | 8/2020 | Quirk | A41D 19/0013 |
| 11,465,034 | B2 * | 10/2022 | Sharp | A41F 1/06 |
| 2004/0034899 | A1 * | 2/2004 | Sullivano | A63B 71/143 2/19 |

(Continued)

*Primary Examiner* — Khaled Annis
*Assistant Examiner* — Dakota Marin
(74) *Attorney, Agent, or Firm* — Neugeboren O'Dowd PC

(57) ABSTRACT

A striking glove may comprise a wrist band; an inner glove for receiving a hand; an outer shell conforming generally to the inner glove; one or more padding layers positioned between the inner glove and the outer shell; and an internal support system between the inner glove and the outer shell. The internal support system comprises at least a first and a second channel disposed on the dorsal side of the glove, and a first strap and a second strap at least partially disposed within the first and second channels and configured in an overlapped and crossed configuration, wherein each of the first and the second strap is configured to be retained within and slide within the respective channel, and wherein ends of the first and second straps extend from a dorsal cavity between the inner glove and the outer shell to an exterior of the striking glove.

20 Claims, 18 Drawing Sheets

(56) References Cited

U.S. PATENT DOCUMENTS

| | | | | |
|---|---|---|---|---|
| 2011/0099687 | A1* | 5/2011 | Skrocki | A41D 19/01523 2/161.1 |
| 2011/0126336 | A1* | 6/2011 | Johnson | A41D 19/001 2/20 |
| 2017/0282048 | A1* | 10/2017 | Wittman | A63B 71/145 |
| 2019/0328062 | A1* | 10/2019 | Kamphuis | A41D 19/01588 |

* cited by examiner

FIGHT GLOVE

CROSS REFERENCE TO RELATED APPLICATIONS

The present Application is a Continuation of U.S. patent application Ser. No. 17/223,205 entitled "FIGHT GLOVE" filed Apr. 6, 2021, which is related to U.S. Nonprovisional patent application Ser. No. 15/469,543 now issued as U.S. Pat. No. 10,376,770 entitled "X splint hand protection device" and assigned to the assignee hereof and hereby expressly incorporated by reference herein.

FIELD OF THE DISCLOSURE

The present disclosure relates generally to a striking glove or a fight glove. In particular, but not by way of limitation, the present disclosure relates to systems, methods and apparatuses for a striking glove configured to provide hand protection.

DESCRIPTION OF RELATED ART

The unique complexity and functionality of the hand is what makes many of the tasks we perform on a daily basis seem simple, and to not require a second thought. It remains a secondary thought until you have an injury to your hand. Approximately 12% of all mixed martial arts (MMA) related injuries are to a participant's hands. An injury to one's hands can result in unwanted time away from training and potentially long term effects that could lead to limited ability to continue to participate in MMA related activities. The injuries to the hands and wrists not only involve breaks to the bones but can also involve injuries to soft tissue around the hand and wrist and/or ligaments in the hand. These soft tissue injuries also commonly require a longer time to recover.

There are several kinds of common hand and wrist injuries in striking sports. One common area for a striking athlete to injure his or her hand is at the level of the metacarpal phalangeal joint (MP joint). The MP joint is the 'large' joint of the fist that is the region in which a person strikes a target. There are two distinct anatomic tissues at risk during a strike in near the MP joint. The first are the sagittal bands. The sagittal bands are a set of tissues located on the dorsal aspect of the MP joint (back of the MP joint/extensor tendon side of the finger) that help to stabilize the extensor tendons from sliding from the ulnar or radial aspect of the MP joint during motion. These tissues can be partially or completely ruptured with a direct blow to them (i.e., punching something). If not treated, a tear can lead to continued pain in the region every time an athlete makes a fist or strikes. Treatment for this injury can include full-time use of a splint for 6 weeks or surgery, with at least 6 weeks off to recover, in more severe cases. The second region of concern is the collateral ligaments of the MP joint. The collateral ligaments function as ropes connecting the metacarpal head to the base of the proximal phalanx. The collateral ligaments act as soft tissue ties holding the joint together. They are located on the direct radial and ulnar aspect of the MP joint and are most often injured through hyperflexion (i.e., excessive bending forward into a closed hand position) or torsional stress to the MP joint.

Another common kind of striking injury is hyperextension of the wrist (i.e., extreme bending backward). Participants know that at times they can land an indirect strike that results in a hyperextension motion to the wrist that results in pain and discomfort. The pain caused by any of the aforementioned types of injuries can lead to frustration and cause athletes to stop participating in striking sports altogether.

Currently available boxing and striking gloves provide padding over the MP joint, as well as wrist support. However, existing gloves present several deficiencies. For instance, existing gloves allow the fist to relax and consequently allow the metacarpal bones, thumb, or pinky to rest in a position where they are more prone to injury. Further, the interior of a glove may stretch over time, so even if the glove fits initially, its fit may deteriorate. Fight gloves may typically be tightened around the wrist through laces, but this tightening does not increase support around the hands themselves. Participants often tape their hands and wrists before inserting them in gloves in order to prevent the aforementioned injuries. However, taping is time consuming and only tightens the hands and wrists themselves, which does not keep the glove itself tight to the hand and therefore, slippage within the glove remains a problem. Therefore, a need exists for striking gloves that remedy these and other deficiencies.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

An aspect of the disclosure provides devices and methods to protect the hands of participants in training and competing in mixed martial arts (MMA), boxing and other sporting activities that involve striking objects or other participants with the hands.

Some embodiments of the disclosure may be characterized as a striking glove comprising: a dorsal side and a palmar side; a wrist band; an inner glove configured to receive a hand; an outer shell conforming generally to the inner glove and defining therebetween a space; one or more padding layers positioned in the space between the inner glove and the outer shell; an internal support system between a first padding layer of the one or more padding layers and the outer shell, the internal support system comprising at least a first channel and a second channel disposed on the dorsal side of the glove; and wherein the internal support system further comprises at least a first strap and a second strap at least partially disposed within the first and second channels and configured in an overlapped and crossed configuration, wherein each of the first and the second strap is configured to be retained within and slide within the respective channel, and wherein ends of the first and second straps extend from a dorsal cavity between the inner glove and the outer shell to an exterior of the striking glove.

Other embodiments of the disclosure may be characterized as a hand protection device comprising: a glove having a dorsal side and a palmar side and configured to receive a hand; a wrist band; an internal support system comprising: at least three channels disposed on the dorsal side of the glove and arranged in an overlapped and crossed configuration; and at least three straps disposed with the at least three channels, one strap for each channel, wherein each strap is configured to be retained within and slide within a respective channel, and wherein at least a portion of a first one of the at least three straps overlaps or crosses over portions of another two of the at least three straps, and wherein at least a portion of a second one of the at least three straps overlaps or crosses over portions of another two of the at least three straps; and wherein the at least three channels terminate in at least four exit holes on the palmar side of the glove, and wherein at least one end of each of the at least three straps exit the exit holes. For instance, in some cases, one of the three straps of the internal support system may comprise a vertical portion and two branched portions (also referred to as branch straps). In some cases, each branch strap may comprise an external end, where the external end exits via a respective exit hole to an exterior of the glove. Further, each of the other two straps (e.g., without a branched portion) may also comprise an external end, where the external end exits via a respective exit hole to an exterior of the glove. In this way, the three straps of the internal support system may comprise four external ends, where each external end exits a respective exit hole to an exterior of the striking glove. In some cases, the external ends may terminate in laces that are independently adjustable or movable to tighten the glove around the user's hand. In some other cases, strings or any other applicable means may be used in lieu of laces.

In some embodiments, the internal support system is configured to at least one of: separate knuckles from tendons of flexor digitorum superficialis in the hand during impact, cross support carpus bones in the hand and wrist during impact, or support number 2, 3, 4, and 5 metacarpus bones in the hand during impact. In some embodiments, the first and the second strap are independently movable.

In some embodiments, the first strap is secured at an internal end between a first finger cavity and a second finger cavity of the striking glove. Additionally or alternatively, in some embodiments, the second strap is secured at an internal end between a third finger cavity and a fourth finger cavity of the striking glove.

In some embodiments, the internal support system further comprises: a third strap disposed within a third channel in the dorsal cavity, the third strap comprising a vertical portion secured at an internal end between the second finger cavity and the third finger cavity, and at least one branched portion extending from the vertical portion to the exterior of the striking glove. In some embodiments, the at least one branched portion comprises two branch straps, each branch strap having an external end extending from the dorsal cavity to the exterior of the striking glove.

In some embodiments, a first branch strap of the two branch straps overlaps or crosses the first strap, and a second branch strap of the two branch straps overlaps or crosses the second strap.

In some embodiments, external ends of the first strap, the second strap, and the first and second branch straps are configured to extend from opening holes in the outer shell at the palmar side to the exterior of the striking glove.

In some embodiments, the striking glove and/or the hand protection device further comprises at least two openings in the outer shell on the palmar side to allow external ends of the first strap and the second strap to extend from the dorsal cavity to the exterior of the striking glove.

In some embodiments, the first strap and the second strap cross on the dorsal side. In some cases, each of the first strap and the second strap terminate in laces, wherein respective laces of the first and the second strap cross on the palmar side.

In some embodiments, the one or more padding layers comprise one or more dorsal padding layers secured between the inner glove and the outer shell, wherein the one or more dorsal padding layers are configured to provide impact protection to dorsal surfaces of one or more of the wrist, metacarpals, metacarpal phalangeal joints, and phalanges.

In some embodiments, the one or more dorsal padding layers comprise one or more foam layers, each of the one or more foam layers selected from a group consisting of a spongy foam layer, a PORON foam layer (e.g., provided by Rogers Corporation of Chandler, AZ), an Ethylene-Vinyl Acetate (EVA) foam layer, a low density foam layer, a high density foam layer, and a mixed density foam layer.

In some embodiments, the striking glove and/or the hand protection device further comprise one or more lateral knuckle padding layers configured to wrap around lateral parts of knuckles and provide protection to at least one of number 2 and number 5 metacarpal knuckles during striking.

In some embodiments, at least a portion of the inner glove is composed of composite leather.

In some embodiments, the striking glove is capable of assuming an open position for grappling and a clenched fist position for striking, wherein the internal support system is configured to force the hand towards the clenched fist position.

In some embodiments, the striking glove is an open-fingered type glove comprising one or more finger cavities.

In some embodiments, the glove is an open-fingered type glove capable of assuming an open position for grappling and a clenched fist position for striking, wherein the internal support system is configured to force the hand towards the clenched fist position.

In some embodiments, the at least three channels are formed by stitching one or more pieces of material to the dorsal side of the glove. In some cases, the at least three channels form a cavity between the dorsal side of the glove and the one or more pieces of material.

In some embodiments, the glove further comprises: one or more lateral knuckle padding layers on the dorsal side, the one or more lateral knuckle padding layers configured to wrap around lateral parts of the knuckles and provide protection to at least one of number 2 and number 5 metacarpal knuckles during striking.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
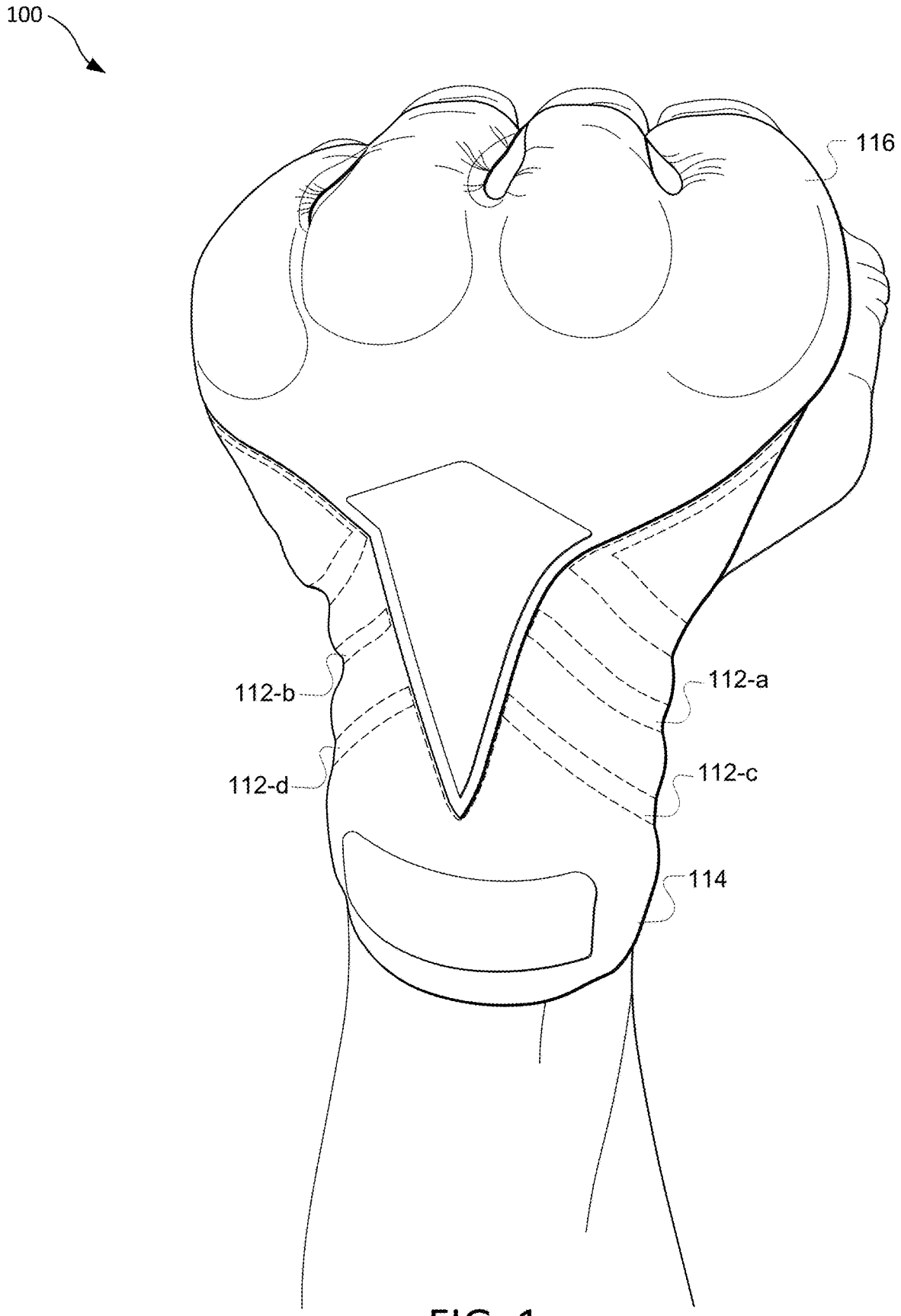
FIG. 1 illustrates a dorsal view of the striking glove according to an embodiment of the disclosure.

The present disclosure relates generally to a striking glove or fight glove. More specifically, but without limitation, the present disclosure relates to a striking glove with an internal support system having one or more straps for providing support to the bones, soft tissues, and/or ligaments of a user's hand. In some examples, the striking glove of the present disclosure may serve as a hand protection device.

The word "exemplary" is used herein to mean "serving as an example, instance, or illustration." Any embodiment described herein as "exemplary" is not necessarily to be construed as preferred or advantageous over other embodiments.

Throughout the present disclosure, the terms "internal strapping", "internal support", "webbing system", "tension system", or "webbing/tension system" may be used somewhat interchangeably and may refer to a feature of the disclosed striking glove or hand-protection device wherein at least two straps cross on the back, or dorsal side, of a hand forming a supportive structure that compresses the bones and soft tissues of the hand. In some embodiments, the internal strapping or support system may be utilized in a foot-protection device, for instance, to form a supportive structure that compresses the bones and/or soft tissues of the foot of the wearer.

As described above, current striking gloves, for instance, for Mixed Martial Arts (MMA) competitions are lacking. Numerous issues have been identified, including backwards (or upwards) forcing of the hand causing injuries to the knuckles and/or metacarpal joints during striking, outer knuckle (i.e., knuckles below the index and pinky fingers) injuries during sideway striking, grappling issues due to fingers being forced upwards when the hand is in a relaxed position (i.e., when hand is not in a closed fist position), lack of support to carpus bones (i.e., carpals), incorrect fist position causing the knuckles, rather than fist to strike the opponent, etc. However, none of the current solutions have adequately resolved most or all of the above identified issues. Additionally, fighters often tape and gauze wrap their hands before competitions in order to prevent the aforementioned injuries. Besides being time consuming, taping only serves to tighten the hand and wrist themselves, which does not keep the glove itself tight to the hand and therefore, slippage within the glove remains a problem. Taping is also inconsistent between fighters, which provides an added advantage to some fighters over others, which is inconsistent with the spirit of the support.

Aspects of this disclosure relate to a striking glove or a hand protection device with an internal support system comprising at least two adjustable straps that allow the glove to confirm specifically to a user's hand size and provide a standardized strapping system for competitions. In some examples, the striking glove comprises one or more dorsal layers and palmar layers, further described in relation to the figures below.

Turning now to FIG. 1, which illustrates a dorsal view of an exterior of the striking glove 100. In some embodiments, the striking glove 100 may be disposed on the hand and wrist of a user to reduce risk of injury to the metacarpals, carpus bones, metacarpal phalangeal joint, and/or phalanges of the user. The striking glove 100 may comprise an inner glove (further described in relation to FIGS. 13-17) having a principal pocket for receiving the user's wrist, metacarpals, metacarpal phalangeal joints, and phalanges. In some embodiments, the inner glove may also comprise a second smaller pocket for receiving the user's thumb, which may be optional. The striking glove 100 in FIG. 1 comprises a wrist band 114 and an outer shell 116 conforming generally to the inner glove and defining therebetween a space. The outer shell 116 may be secured to the inner glove, and the inner glove and outer shell 116 may be configured to connect to the wrist band 114 (e.g., by stitching or unitary construction).

Figure 2:
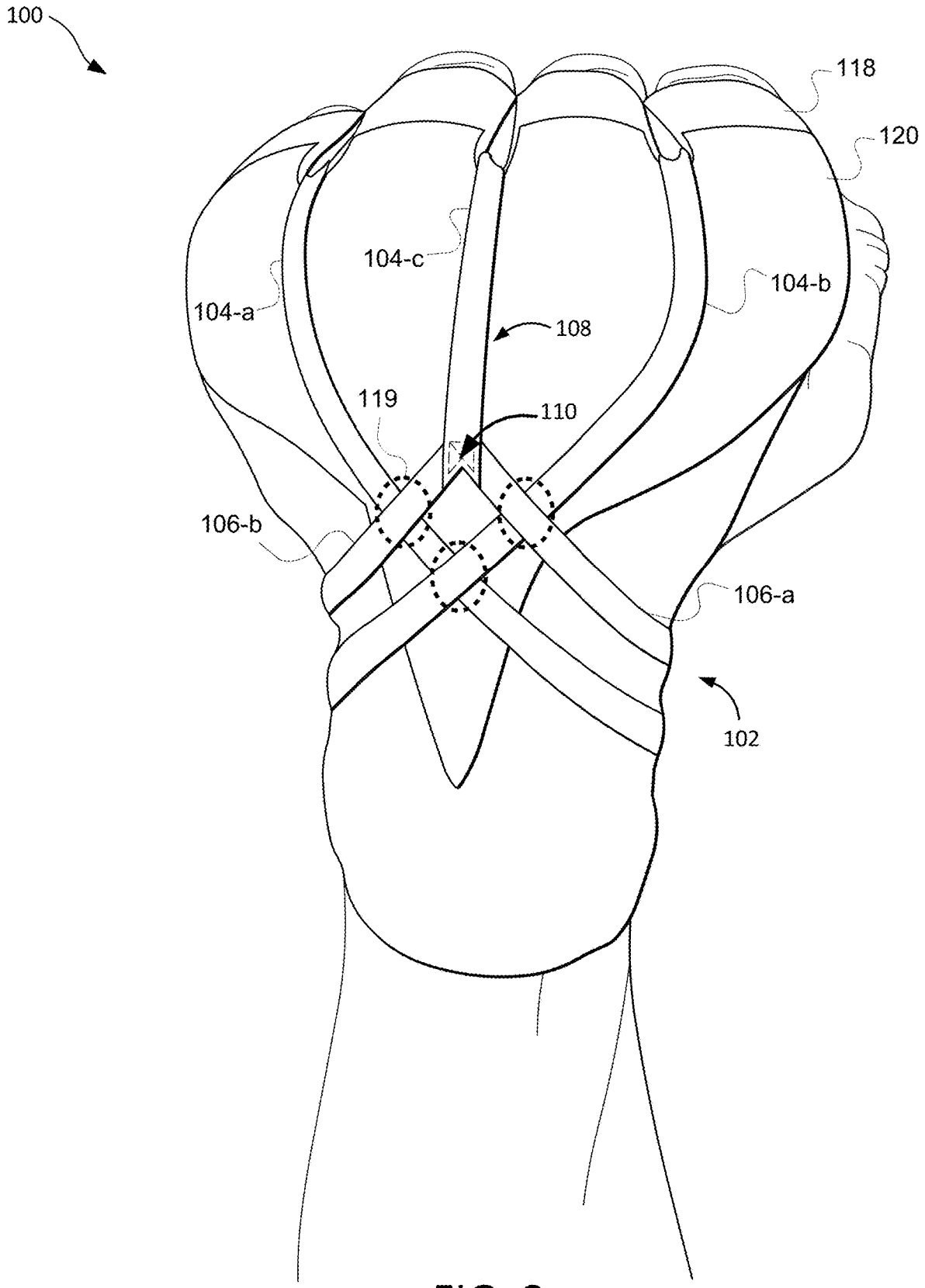
FIG. 2 illustrates a dorsal view of the striking glove in FIG. 1 showing an internal support system, according to an embodiment of the disclosure.

FIG. 2 illustrates a dorsal view of a striking glove 100 comprising an internal support system 102, the internal support system 102 having one or more internal straps 104 (e.g., internal strap 104-*a*, internal strap 104-*b*, internal strap 104-*c*). As seen, the internal straps 104 are arranged in a crossed or overlapping configuration. In some embodiments, the internal strap 104-*c* is shaped in an inverted Y configuration and comprises a vertical portion 108 and a branched portion 110. The branched portion 110 comprises two branch straps 106 (e.g., branch straps 106-*a* and 106-*b*), each branch strap 106 having an external end extending from the dorsal side of the glove to the exterior of the striking glove. Further, internal straps 104-*a* and 104-*b* are arranged such that they cross the other of the internal strap 104-*a* or 104-*b*, as well as one branch strap 106 of the branched portion 110 of the internal strap 104-*c* (shown by the dotted ovals 119). In this way, each internal strap 104 crosses the other two internal straps 104 at at least one location. In some cases, the crossing locations (i.e., dotted ovals 119) overlap with at least a portion of the carpus bones and serve to provide support to said carpus bones and minimize the likelihood of injuries. Each of the internal straps 104 extends from the dorsal side of the striking glove to an exterior of the striking glove. In some cases, each of the internal straps 104, including the branch straps 106 of the internal strap 104-*c* are independently movable. In some non-limiting examples, the internal straps 104 terminate in laces that extend from opening holes (e.g., shown as opening holes 1350 in FIG. 13) in the striking glove at the palmar side. In some cases, the internal straps 104 are configured to be retained within and slide within a respective channel. Returning to FIG. 1, which illustrates an outline of one or more channels 112 (e.g., channel 112-*a*, channel 112-*b*, channel 112-*c*, and channel 112-*d*) for retaining the one or more internal straps 104. For instance, channels 112-*c* and 112-*d* may serve to retain at least a portion of internal straps 104-*a* and 104-*b*, respectively, while channels 112-*a* and 112-*b* may each serve to retain at least a portion of one of the branched straps 106.

In some cases, the internal straps 104 of the internal support system 102 may not only serve to provide support to the carpus and metacarpal bones, but may also provide support to the ligaments and/or joints between the fingers of the user's hand and prevent them from getting flexed. For instance, the distal portions (i.e., towards the knuckles and away from the wrist) of the internal straps 104-*a* and 104-*b* and the vertical portion 108 of the internal strap 104-*c* may facilitate in providing support to the ligaments (e.g., interosseus metacarpal ligaments) between the pinky and ring finger, ring and middle finger, and middle and index (or pointer) finger, respectively, of the user's hand. Further, the inverted Y strap (i.e., internal strap 104-*c*) and the internal straps 104-*a* and 104-*b* may help pull the metacarpals of the user's hand closer together, which may facilitate in reducing injuries during striking. In some cases, the branch straps 106 of the internal strap 104-*c* may also serve to provide support to the one or more carpus bones in the user's hand.

In some cases, one or more dorsal padding layers (e.g., dorsal padding layer 118, dorsal padding layer 120) may be positioned in the space (e.g., in a dorsal cavity) between the inner glove and the outer shell 116.

Figure 3:
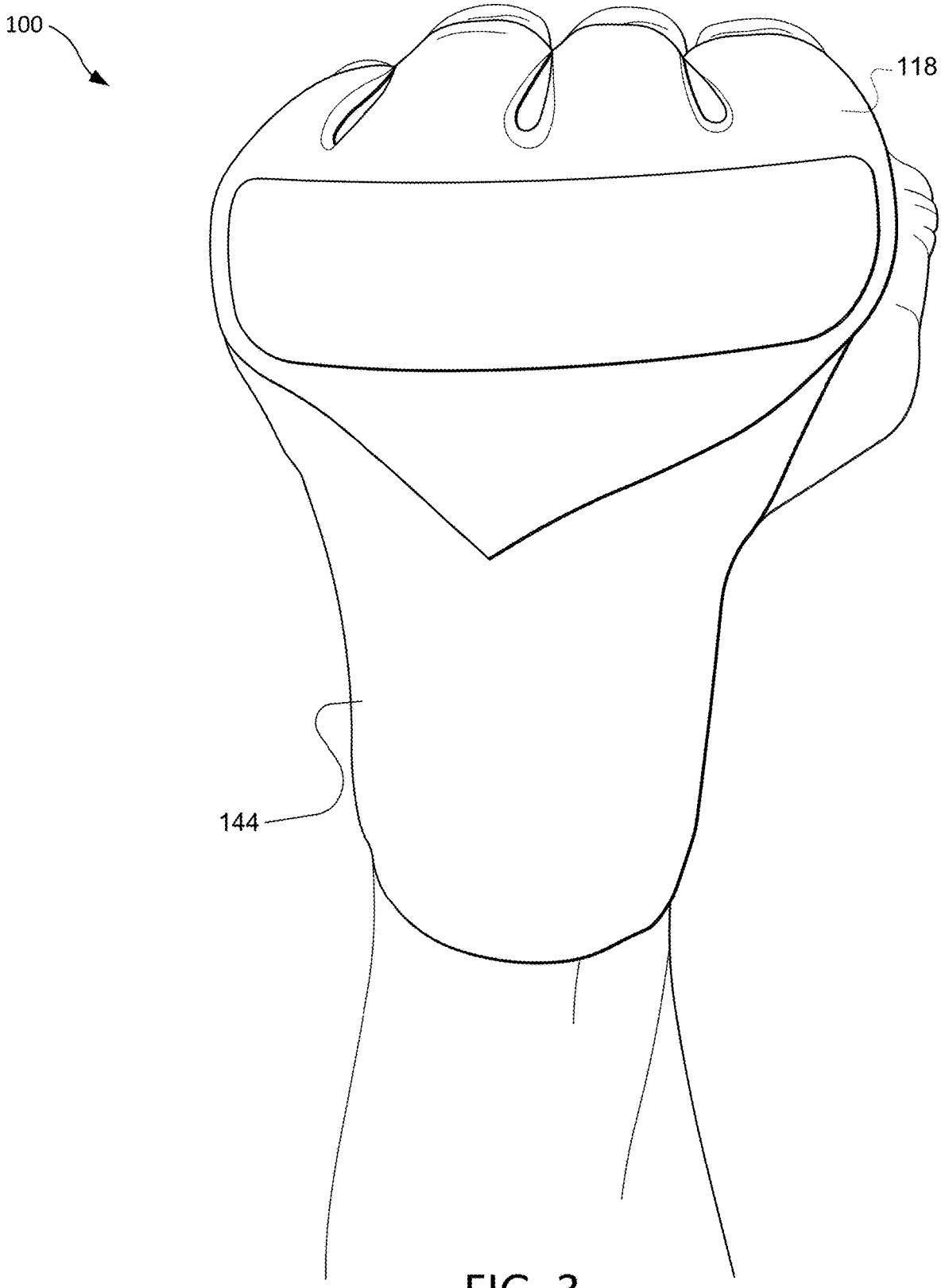
FIG. 3 illustrates a dorsal view of the striking glove in FIG. 1, in accordance with one or more implementations.

Turning now to FIG. 3 which illustrates one example of a first dorsal padding layer 118 (also referred to simply as, first padding layer 118). The first padding layer 118 may be positioned on a dorsal side of the inner glove and in the space between the inner glove and the outer shell.

Figure 4:
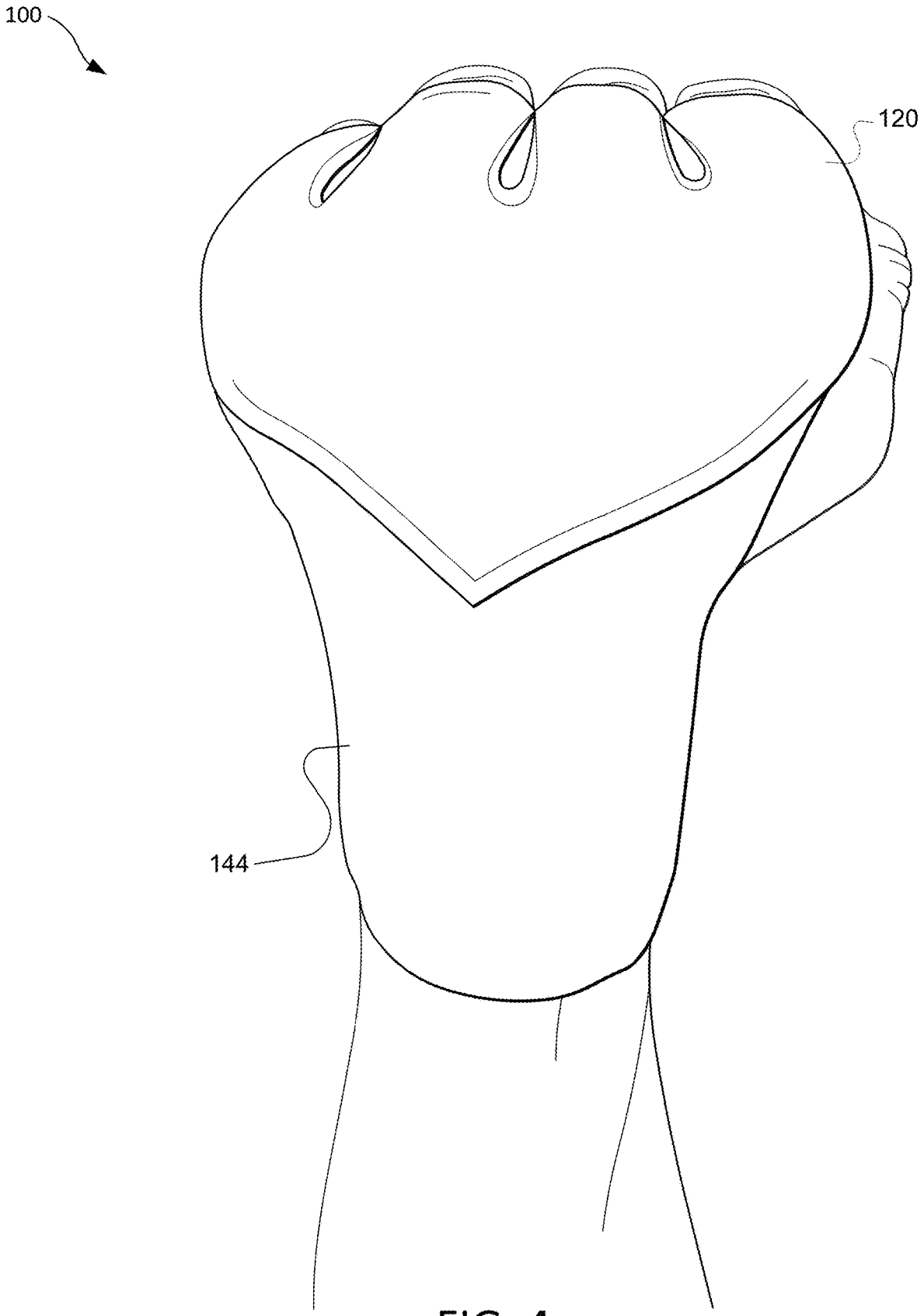
FIG. 4 illustrates a dorsal view of the striking glove in FIG. 1, in accordance with one or more implementations.

FIG. 4 illustrates an example of a second dorsal padding layer 120 (also referred to simply as, second padding layer 120) positioned between the first dorsal padding layer 118 and the outer shell. Returning to FIG. 2, the internal support system 102 may be positioned on a dorsal side of the second padding layer 120. In some cases, the internal channels (e.g., shown as channels 112 in FIG. 1) within which the straps of the internal support system 102 are disposed, may be formed by stitching one or more pieces of material to the dorsal side of the glove. For instance, the internal channels 112 may form a cavity between the dorsal side of the glove and the one or more pieces of material, further described in relation to FIGS. 5 and 8.

Figure 5A:
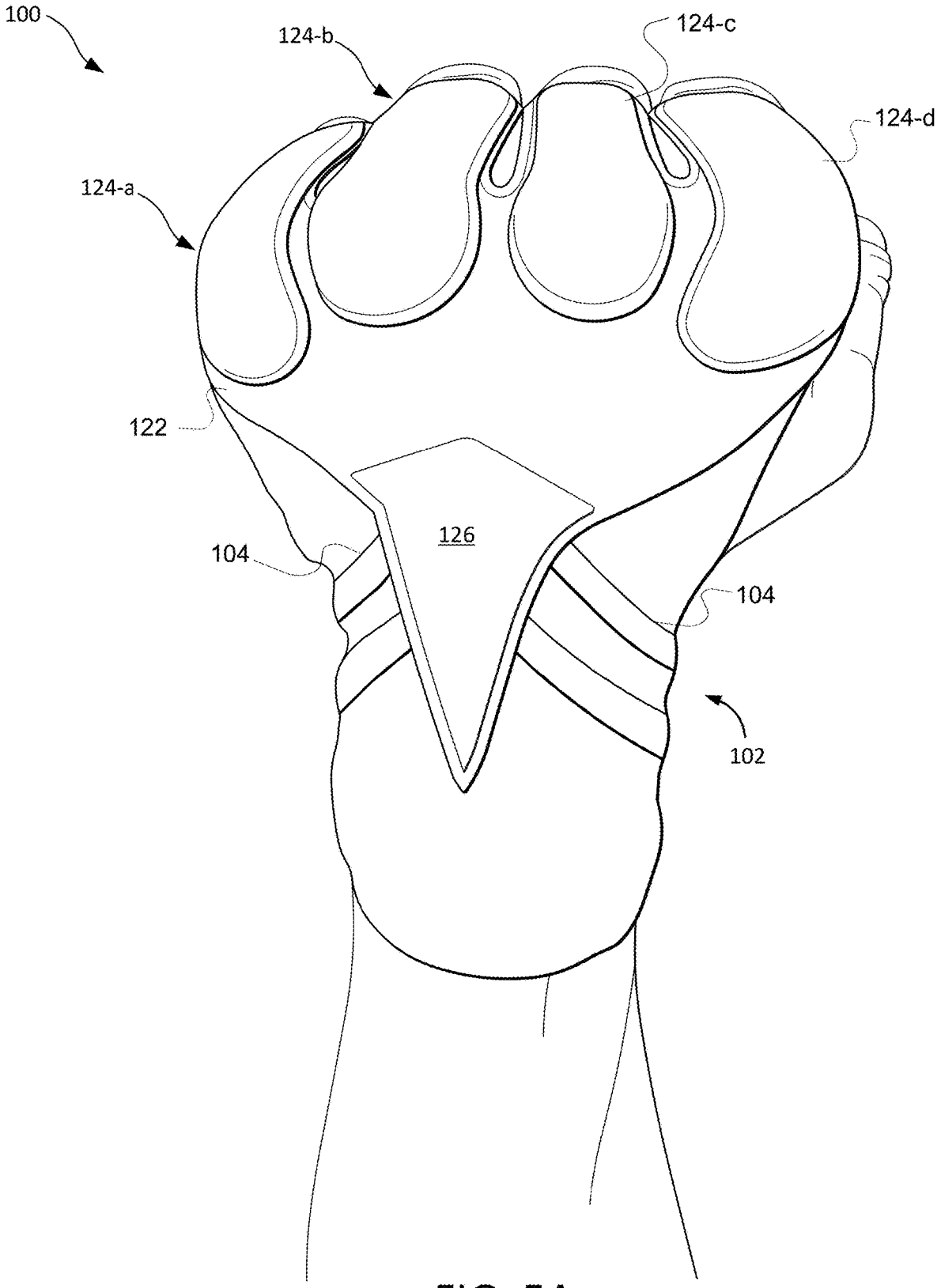
FIG. 5A illustrates a dorsal view of the striking glove in FIG. 1, in accordance with one or more implementations.

FIG. 5A illustrates the striking glove 100 with one or more pieces of material 122 stitched on the dorsal side to form a cavity between the dorsal side of the glove and the one or more pieces of material 122. The striking glove 100 in FIG. further comprises a metacarpal padding layer 126 (also shown as metacarpal padding layer 926 in FIG. 9), and one or more knuckle padding layers 124 (e.g., knuckle padding layers 124-*a*, 124-*b*, 124-*c*, and 124-*d*) shaped and positioned to cover the knuckles of the user's hand. The knuckle padding layers 124 may afford strike and shock protection to the dorsal surfaces of the user's knuckles, metacarpal phalangeal joints, and/or phalanges. As seen, the outer knuckle padding layers 124-*a* and 124-*d* may be shaped and sized to provide protection to the outer knuckles (i.e., knuckles associated with the index and pinky fingers) when the user's hand is in a closed fist position. A significant portion of the striking gloves used today, especially in MMA competitions, lack padding layers to provide such protection. According to aspects of this disclosure, the internal support system 102 is configured to force the outer knuckle padding layers to surround and wrap the outer (exposed) portions of the knuckles when the internal straps 104 are tightened. While current gloves afford some protection to a user's knuckles during a forward facing strike, they provide little to no protection during a side strike (i.e., when the side of a user's hand swipes or strikes the opponent) since the outer portions of their knuckles are exposed. In some cases, the knuckle padding layers may be composed of foam (e.g., PORON foam provided by Rogers Corporation of Chandler, AZ, Ethylene-vinyl acetate (EVA) foam, spongy foam, etc.), or any other applicable material designed to minimize the force or pressure exerted on the user's knuckles and/or metacarpal phalangeal joints during striking. In some cases, a portion of the straps 104 of the internal support system 102 may be visible from the outside of the glove. Alternatively, the internal straps 104 may not be visible at all from the outside of the glove, or they may be outlined by the stitching of the channels 112 (as seen in FIG. 1) in which the straps are disposed.

Figure 5B:
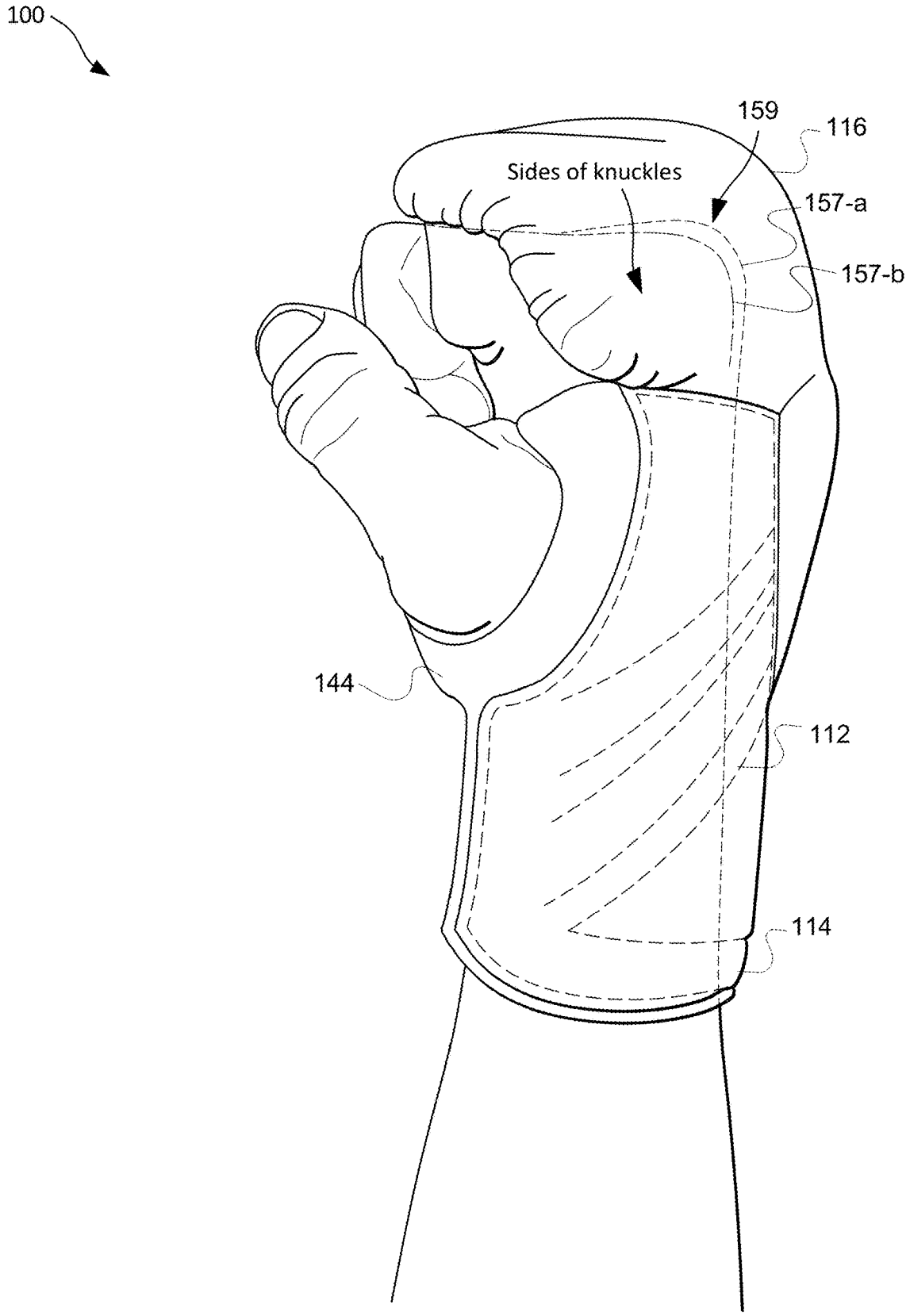
FIG. 5B illustrates a side view of the striking glove in FIG. 1, in accordance with one or more implementations.

FIG. 5B illustrates a side view of the striking glove 100 according to an embodiment of the disclosure. As seen, the striking glove 100 comprises the outer shell 116, the wrist band 114, one or more channels 112 for retaining the straps of the internal support system, the inner glove 144, and one or more dorsal padding layers in a cavity between the inner glove 144 and the outer shell 116. As discussed above, the striking glove 100 may further comprise one or more knuckle padding layers (shown as knuckle padding layers 124 in FIG. 5A) disposed between the inner glove and the outer shell and configured to provide strike protection to the sides of the knuckles (e.g., the number 2 and number 5 metacarpal knuckles). In some aspects, FIG. 5B illustrates an example visualization of a region (e.g., the sides of the knuckles) of the user's hand that may be protected by a knuckle padding layer (e.g., knuckle padding layer 124-*a* in FIG. 5A) of the striking glove 100, for instance, during a side strike (i.e., when the side of a user's hand, rather than the fist, swipes or strikes an opponent).

In some cases, the internal support system of the striking glove 100 may help a user in maintaining their hand in a true fist position (i.e., such that the radius, ulna, metacarpal, and carpal bones are aligned) by forcing the hand slightly downward, which may mitigate the likelihood of the user's wrist being forcefully bent backwards. Dotted lines 157-*a* and 157-*b* depict examples of a true fist orientation where the radius, ulna, metacarpal, and/or carpal bones of the user's arm and hand are aligned. Further, the fist orientation depicted by dotted 157-*a* shows a downward bend 159. In some cases, this downward bend 159 may serves to alleviate the risk of wrist and/or hand injuries during striking. In some examples, adjustment (e.g., tightening) of the straps of the internal support system may not only help achieve this downward bend 159 (e.g., to minimize the risk of finger pokes when the fist is an open position, reduce wrist injuries, ease the amount of force required to move from an open fist to a closed fist position, etc.), but also help wrap one or more knuckle padding layers along the sides of the knuckles. It should be noted that, while FIG. 5B only illustrates the side knuckle protection afforded on one side of the hand (e.g., side of hand with number 2 metacarpal knuckle), similar principles may apply for the other side of the hand (i.e., with the number 5 metacarpal knuckle). Furthermore, while FIG. 5B illustrates an exposed thumb, in some other cases, one or more of the dorsal padding layers, knuckle padding layers, and/or outer shell may also cover at least a portion of the thumb (e.g., the metacarpal, proximal phalange, etc., associated with the thumb).

Figure 6:
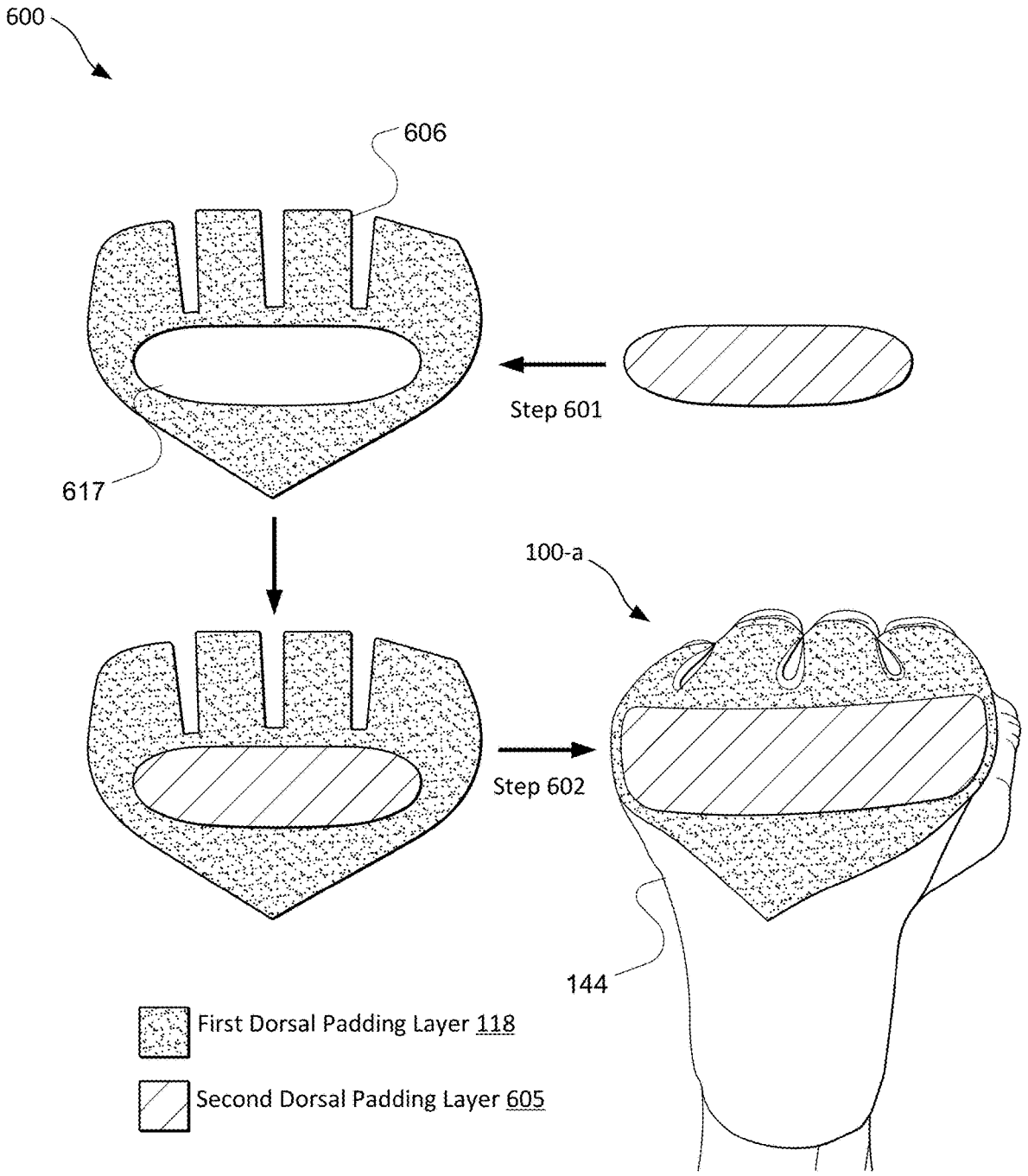
FIG. 6 illustrates a process flow for manufacturing the dorsal side of the striking glove, in accordance with one or more implementations.

FIG. 6 illustrates a process flow 600 for manufacturing the dorsal side of the striking glove 100. In some embodiments, the striking glove 100 comprises one or more dorsal padding layers, such as dorsal padding layers 118 and 605, disposed in a space between an inner glove 144 and the outer shell (shown as outer shell 116 in FIG. 1). As shown, the dorsal padding layer 118 may comprise a cutout 617 shaped and sized to receive the dorsal padding layer 605. Further, the dorsal padding layer 118 may be shaped and sized to cover at least a portion of the dorsal side of the user's hand. For instance, the dorsal padding layers 118 and 605 may be configured to overlap a portion of the user's metacarpal bones, phalanxes, and metacarpal phalangeal joints when the user's hand is in the striking glove. In the example shown, the dorsal padding layer 118 comprises four extending portions 606, one for each finger. In some other cases, the dorsal padding layer 118 may comprise an optional fifth extended portion (not shown), for instance, for the user's thumb. In some cases, the dorsal padding layers 118 and 605 may be separate layers and formed using different materials (e.g., different types of foam). In one non-limiting example, the dorsal padding layer 118 may be composed of spongy foam, while the dorsal padding layer 605 may be composed of EVA foam. The padding layers 118 and 605 may have the same thickness (e.g., ¼ inch, ½ inch, etc.) or a different thickness. Additionally or alternatively, the padding layers 118 and 605 may have the same or a different density.

As shown, at step 601, the process flow 600 may comprise positioning dorsal padding layer 605 within the cutout 617 in the dorsal padding layer 118. Further, at step 602, the process flow 600 may comprise affixing (e.g., stitching, gluing, or through any other means) the first dorsal padding layer comprising the dorsal padding layers 605 and 118 to the dorsal side of the inner glove 144.

Figure 7:
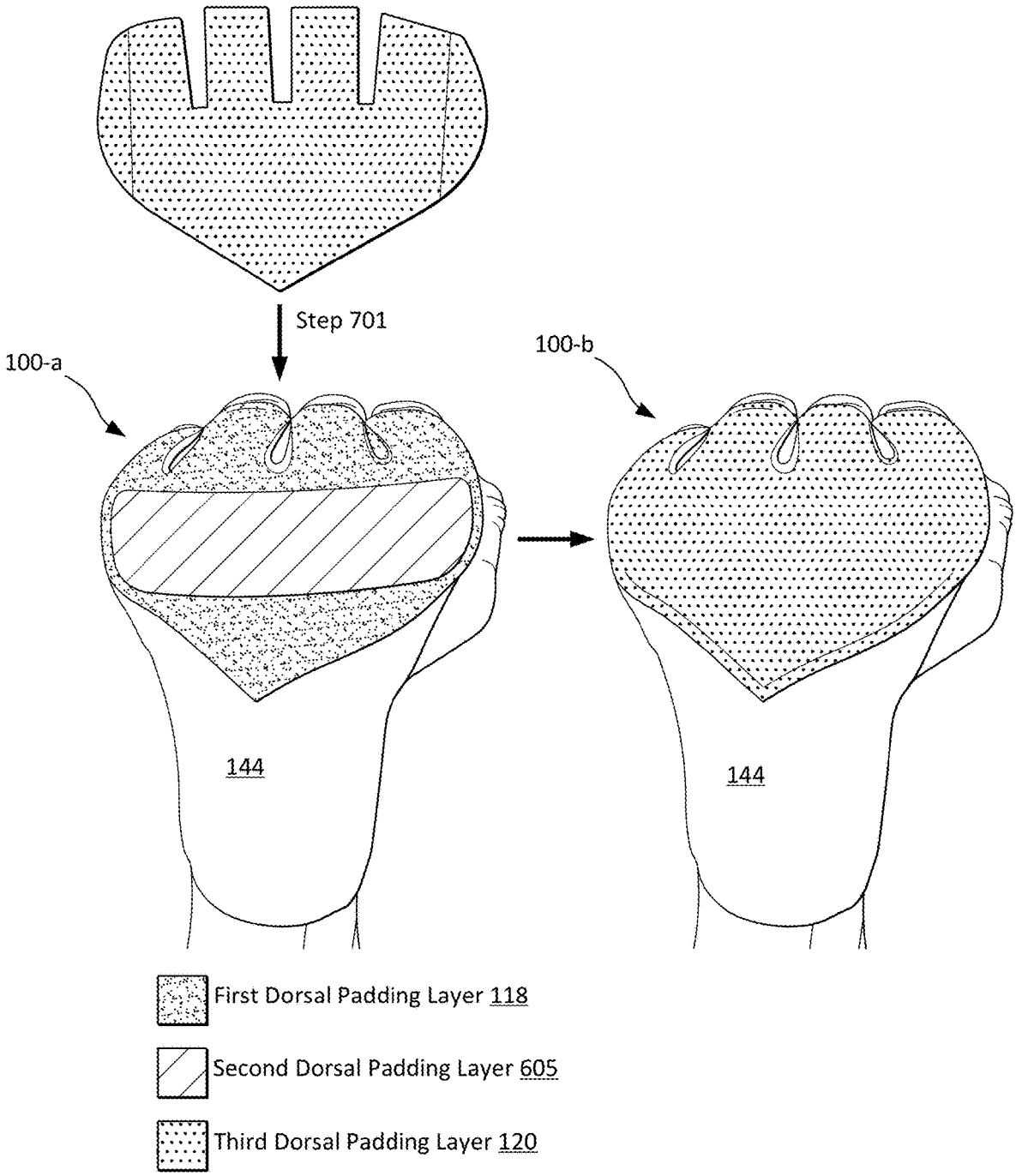
FIG. 7 illustrates a process flow for manufacturing the dorsal side of the striking glove, in accordance with one or more implementations.

Turning now to FIG. 7, which illustrates a process flow 700 for manufacturing the dorsal side of the striking glove 100. In some examples, the process flow 700 continues the process flow 600 from FIG. 6. Following process flow 600, the striking glove 100-*a* now comprises one or more dorsal padding layers (e.g., dorsal padding layers 118 and 605, previously described in relation to FIG. 6). In some cases, at step 701, a third dorsal padding layer 120 (also shown as dorsal padding layer 120 in FIG. 4) may be positioned in the space between the inner glove 144 and the outer shell, for instance, between the dorsal padding layers 118 and 605 and the outer shell (e.g., shown as outer shell 116 in FIG. 1). As illustrated, the dorsal padding layer 120 of striking glove 100-*b* may be shaped and sized to substantially overlap the padding layer 118. In some embodiments, the dorsal padding layer 120 may be formed using PORON foam provided by Rogers Corporation of Chandler, AZ, although other types of foam, such as EVA foam or spongy foam are also contemplated in different embodiments.

Figure 8:
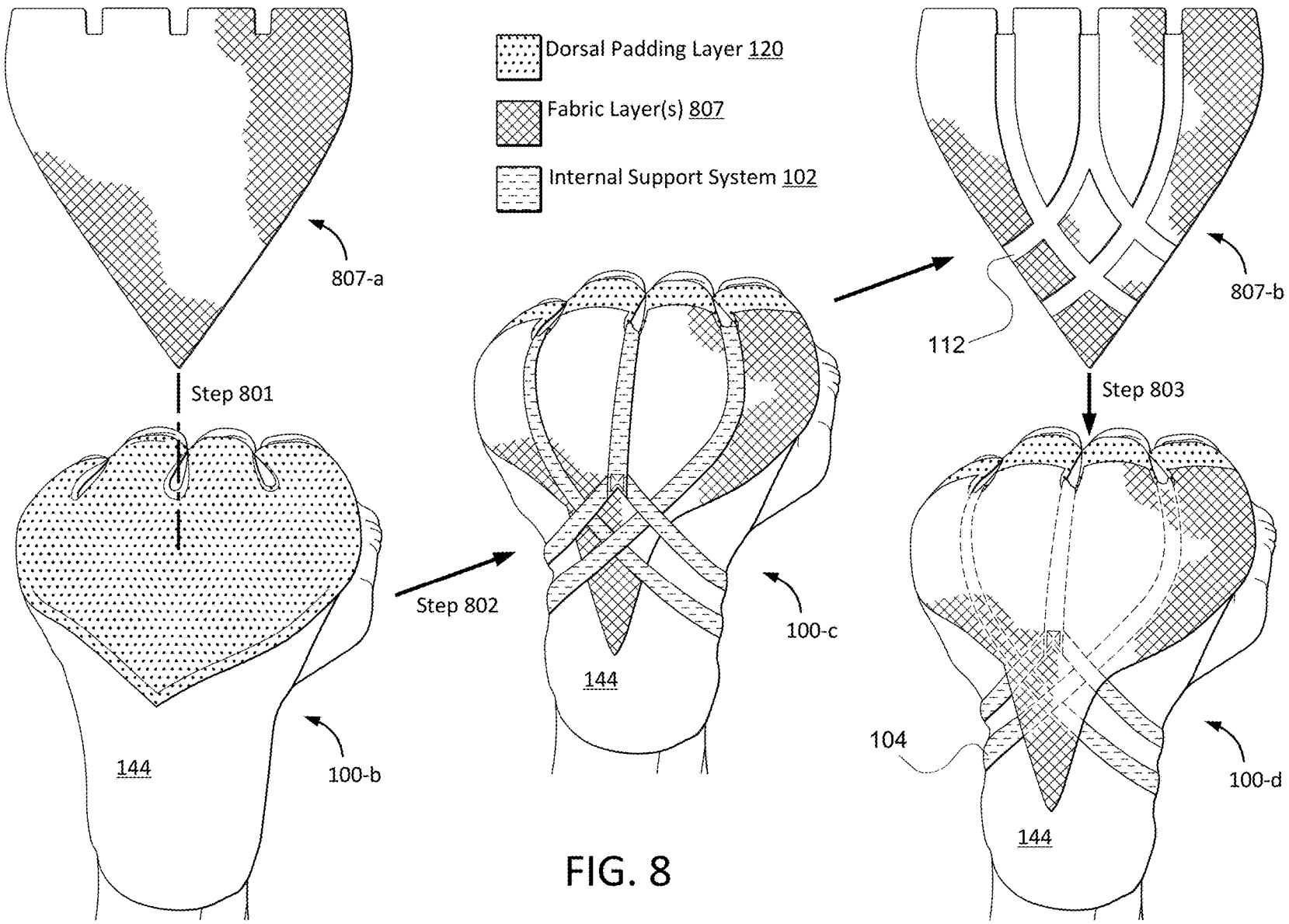
FIG. 8 illustrates a process flow for manufacturing the dorsal side of the striking glove, in accordance with one or more implementations.

FIG. 8 illustrates a process flow 800 for manufacturing the dorsal side of the striking glove 100. In some examples, process flow 800 continues the process flow 700 from FIG. 7. FIG. 8 illustrates the striking glove 100-*b* from FIG. 7, where the striking glove 100-*b* now comprises one or more dorsal padding layers (e.g., dorsal padding layer 120). In some embodiments, at step 801, a first fabric layer 807-*a* may be affixed or stitched on top of the dorsal padding layer 120, where the first fabric layer 807-*a* may be composed of cotton, canvas, linen, denim, hemp, or any other applicable material. For instance, in one non-limiting example, the first fabric 807 may be composed of canvas made using cotton or linen, along with polyvinyl chloride (PVC). In another example, the first fabric 807 may be composed of hemp. After stitching or affixing the first fabric layer 807-*a* to the dorsal side of striking glove 100-*b*, the process flow 800 may comprise positioning an internal support system 102 over the first fabric layer 807-*a* (step 802). In some cases, the internal support system 102 may be similar or substantially similar to the internal support system 102 previously described in relation to FIG. 2 and may comprise one or more internal straps arranged in an overlapping or crossed configuration. Striking glove 100-*c* depicts this intermediate step, where the striking glove 100-*c* now comprises at least the dorsal padding layer 120, first fabric layer 807-*a*, and the internal support system 102. At step 803, a second fabric layer 807-*b* may be stitched or affixed to the dorsal side of the striking glove 100-*c*. In some embodiments, the second fabric layer 807-*b* comprises one or more channels 112 within which the straps of the internal support system 102 may be disposed. In some cases, the second fabric layer 807-*b* may form a cavity having one or more channels 112 between the first and second fabric layers 807. Further, the straps 104 of the internal support system 102 may be configured to slide within the channels 112. In some embodiments, the channels 112 may be configured to guide the reversible tightening of the internal straps (e.g., shown as internal straps 104-*a*, 104-*b*, and 104-*c*) to compress the user's metacarpals, metacarpal phalangeal joints, and phalanges. In some cases, the exterior of the striking glove may comprise a plurality of opening holes (shown as opening holes 1350 in FIG. 13) through which external ends of the internal straps may be pulled (e.g., to tighten the glove around the user's hand). In some cases, the external ends of the internal straps 104 may terminate in laces on the palmar side of the striking glove. Furthermore, the laces may cross in one or more x patterns (i.e., overlapped or crossed configuration) on the palmar side and in an opposite direction to the crossing(s) on the dorsal side. A user may tighten or loosen the laces on the palmar side to adjust the fitting of the striking glove. In some cases, there may be four opening holes (i.e., one for each of the internal straps 104-*a* and 104-*b*, and two for the internal strap 104-*c* comprising branched portions 106). Further, each of the four external ends of the internal straps 104 may be configured to be independently movable or adjustable.

Figure 9:
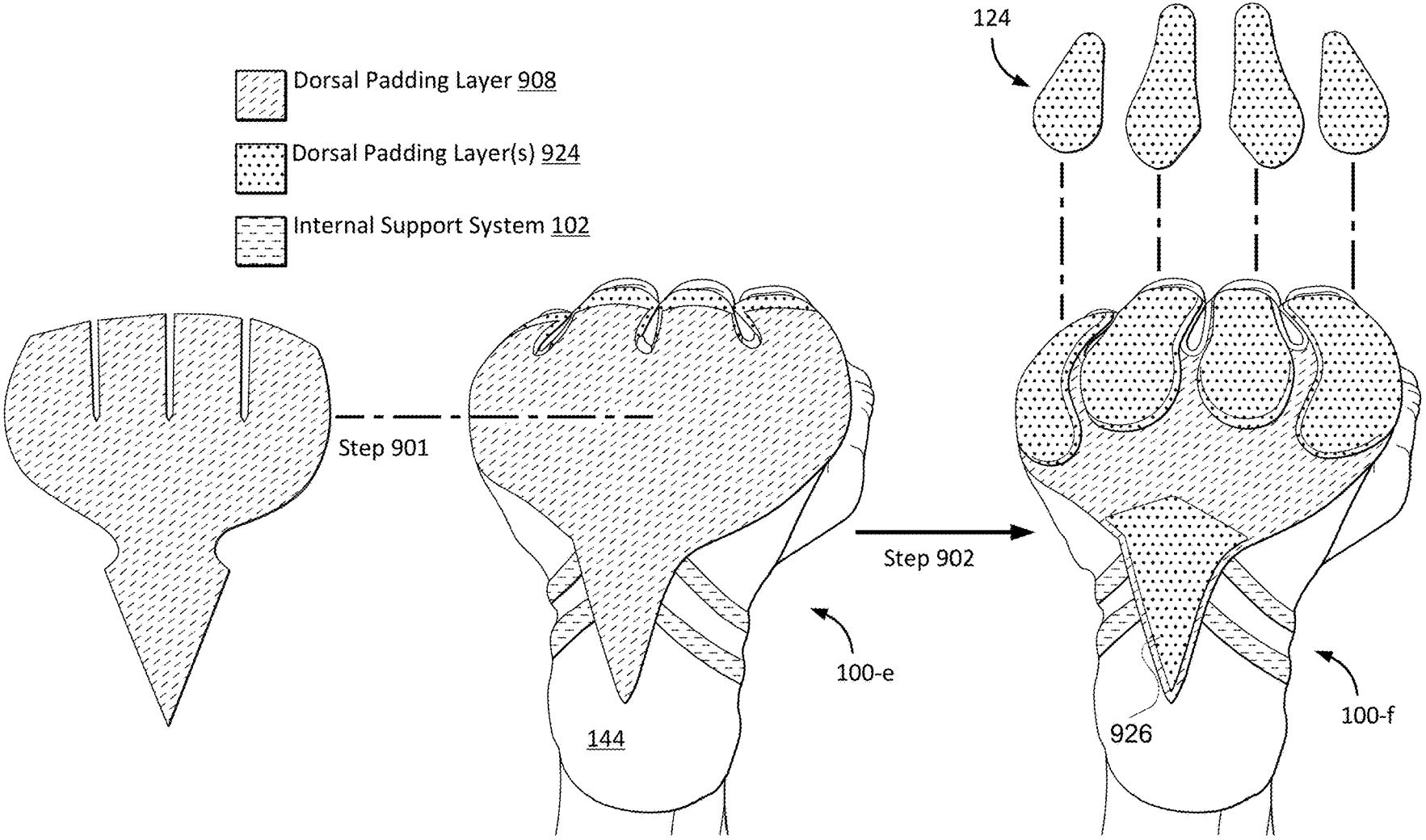
FIG. 9 illustrates a process flow for manufacturing the dorsal side of the striking glove, in accordance with one or more implementations.

FIG. 9 illustrates a process flow 900 for manufacturing the dorsal side of the striking glove 100. In some examples, process flow 900 continues the process flow 800 from FIG. 8. At step 901, a dorsal padding layer 908 may be positioned on a dorsal side of the second fabric layer 807-*b* of striking glove 100-*d* (shown in FIG. 8). Striking glove 100-*e* depicts this intermediate step, where the striking glove 100-*e* now comprises the dorsal padding layer 908, dorsal padding layer 120, and the internal support system 102. In some examples, at least a portion of the straps 104 of the internal support system 102 may be visible and may comprise external ends extending from the dorsal side to an exterior of the striking glove. In some embodiments, the straps 104 may terminate in laces, where the laces extend from opening holes (not shown) in the striking glove at the palmar side.

At step 902, one or more additional dorsal padding layers 924 may be affixed to a dorsal side of the dorsal padding layer 908. Striking glove 100-*f* depicts this intermediate step. As shown, the dorsal padding layers 924 of striking glove 100-*f* may comprise one or more knuckle padding layers 124 and a metacarpal padding layers 926. In some embodiments, the knuckle padding layers 124 may be similar or substantially similar to the knuckle padding layers 124 previously described in relation to FIG. 4.

Figure 10:
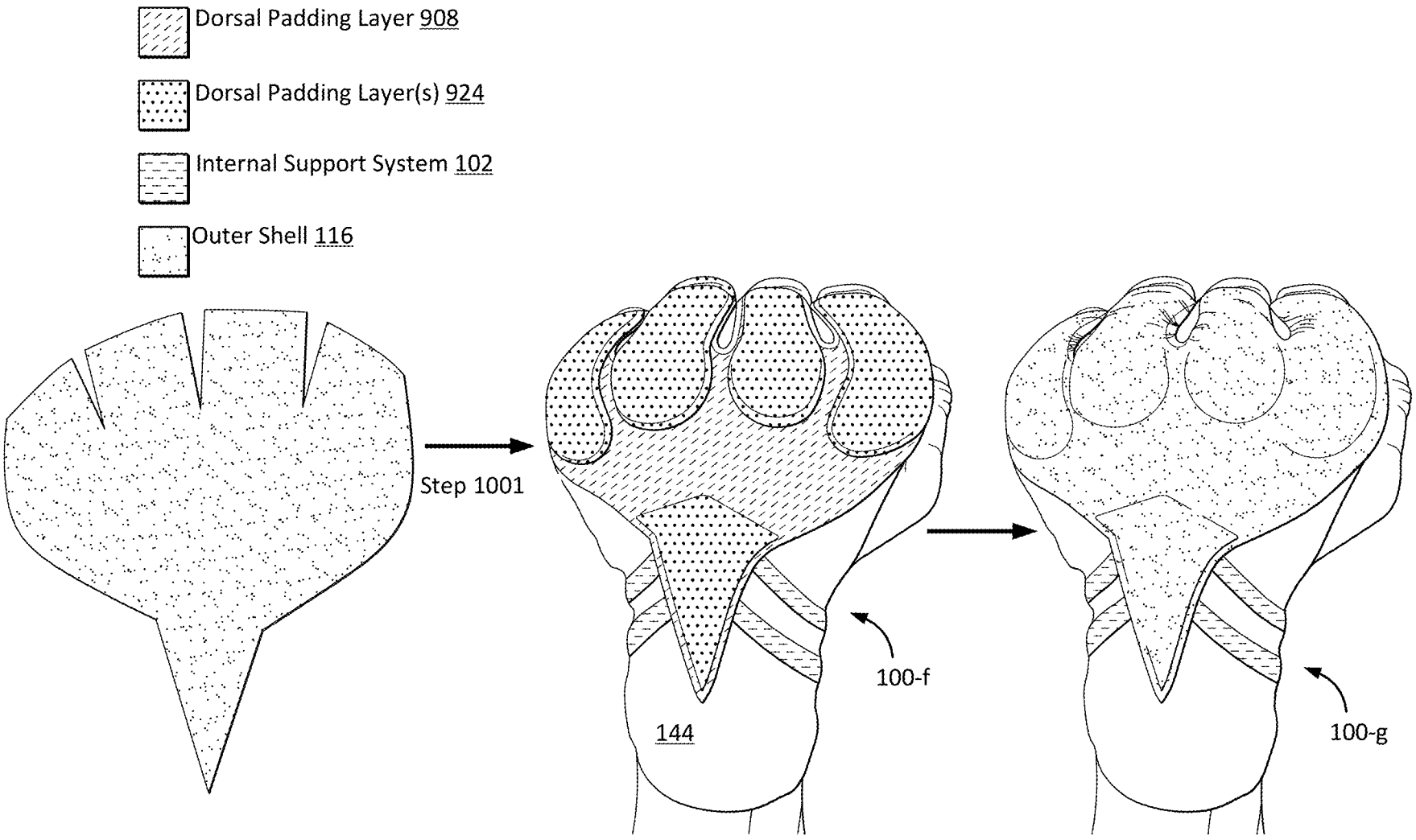
FIG. 10 illustrates a process flow for manufacturing the dorsal side of the striking glove, in accordance with one or more implementations.

FIG. 10 illustrates a process flow 1000. In some examples, process flow 1000 continues from process flow 900 in FIG. 9 (i.e., from intermediate striking glove 100-*f*). As shown, at step 1001, an outer shell 116 may be affixed to the dorsal side of the striking glove 100-*f* (i.e., the striking glove 100-*f* following step 902 in FIG. 9), now shown as striking glove 100-*g*. In some cases, the outer shell 116 may be shaped and sized to substantially overlap the dorsal padding layer 908 and the dorsal padding layers 924, where the dorsal padding layer 924 comprises the one or more knuckle padding layers 124 and the metacarpal padding layer 926.

Figure 11:
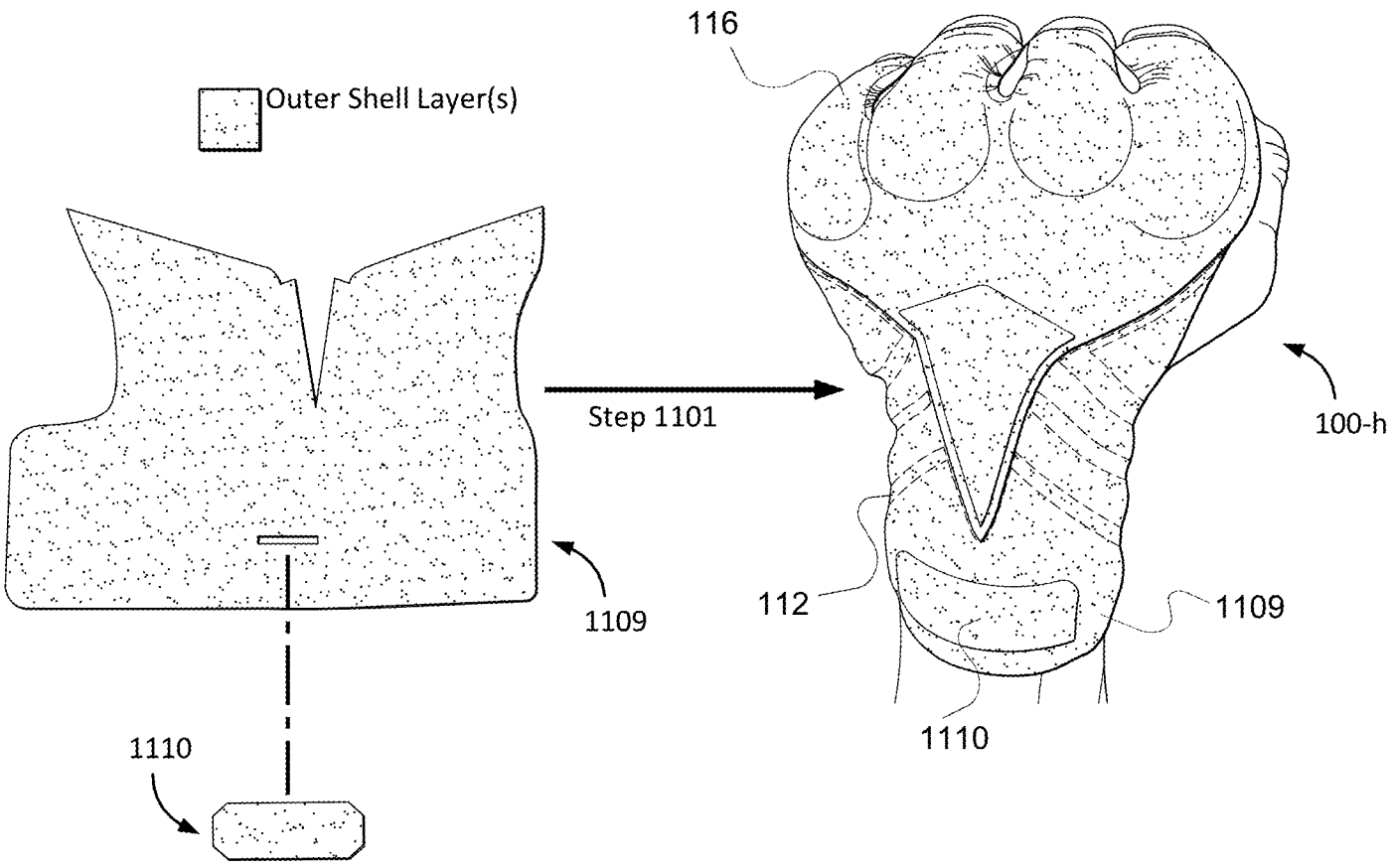
FIG. 11 illustrates a process flow for manufacturing the dorsal side of the striking glove, in accordance with one or more implementations.

FIG. 11 illustrates a process flow 1100, where a wrist band layer 1109 may be affixed (e.g., stitched) on a dorsal side of the inner glove at step 1101. In some examples, process flow 1100 continues the process flow 1000 from FIG. 10 (i.e., from intermediate striking glove 100-*g*). In some embodiments, striking glove 100-*h* may be similar or substantially similar to the striking glove 100 previously described in relation to FIG. 1 and comprises one or more dorsal padding layers and/or fabric layers and an internal support system positioned in the space between the outer shell 116 and inner glove. In some embodiments, the wrist band layer 1109 may be similar or substantially similar to the wrist band layer 114 previously discussed in relation to FIG. 1. In some examples, the wrist band layer 1109 and the outer shell 116 may be separate pieces, or alternatively, may be a unitary construction. Further, the wrist band layer 1109 and the outer shell 116 may be formed using the same material, such as leather (e.g., composite leather, synthetic leather, etc.), or using different materials. In some cases, the wrist band layer 1109 may comprise an optional cutout 1110, for instance, for displaying a logo, a product name, etc.

Figure 12:
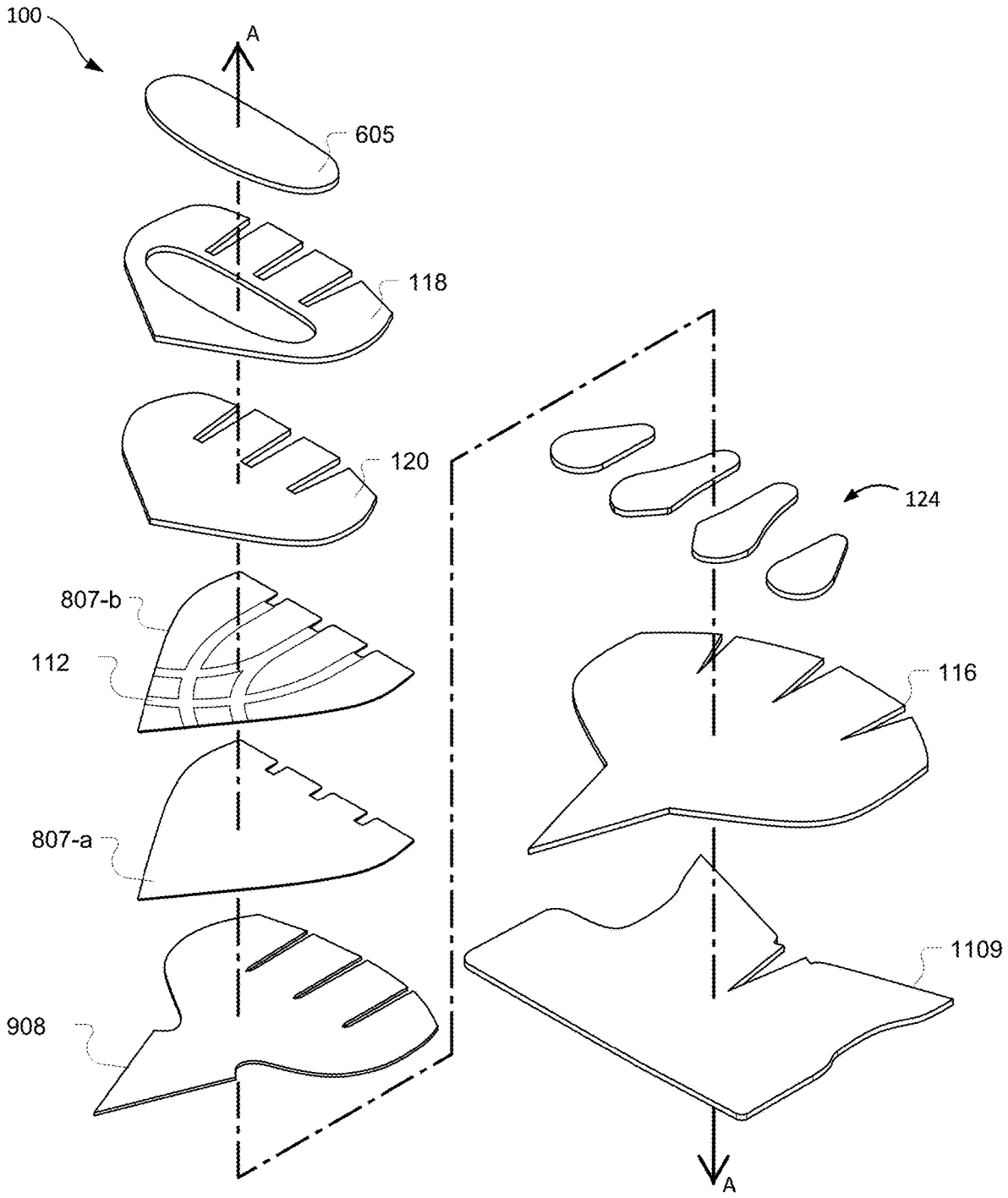
FIG. 12 illustrates an exploded view of the dorsal side of the striking glove, in accordance with one or more implementations.

FIG. 12 illustrates an exploded view of the dorsal side of the striking glove 100, according to an embodiment of the disclosure. FIG. 12 implements one or more aspects of the process flows 600-1100, previously described in relation to FIGS. 6-11, respectively.

Figure 13:
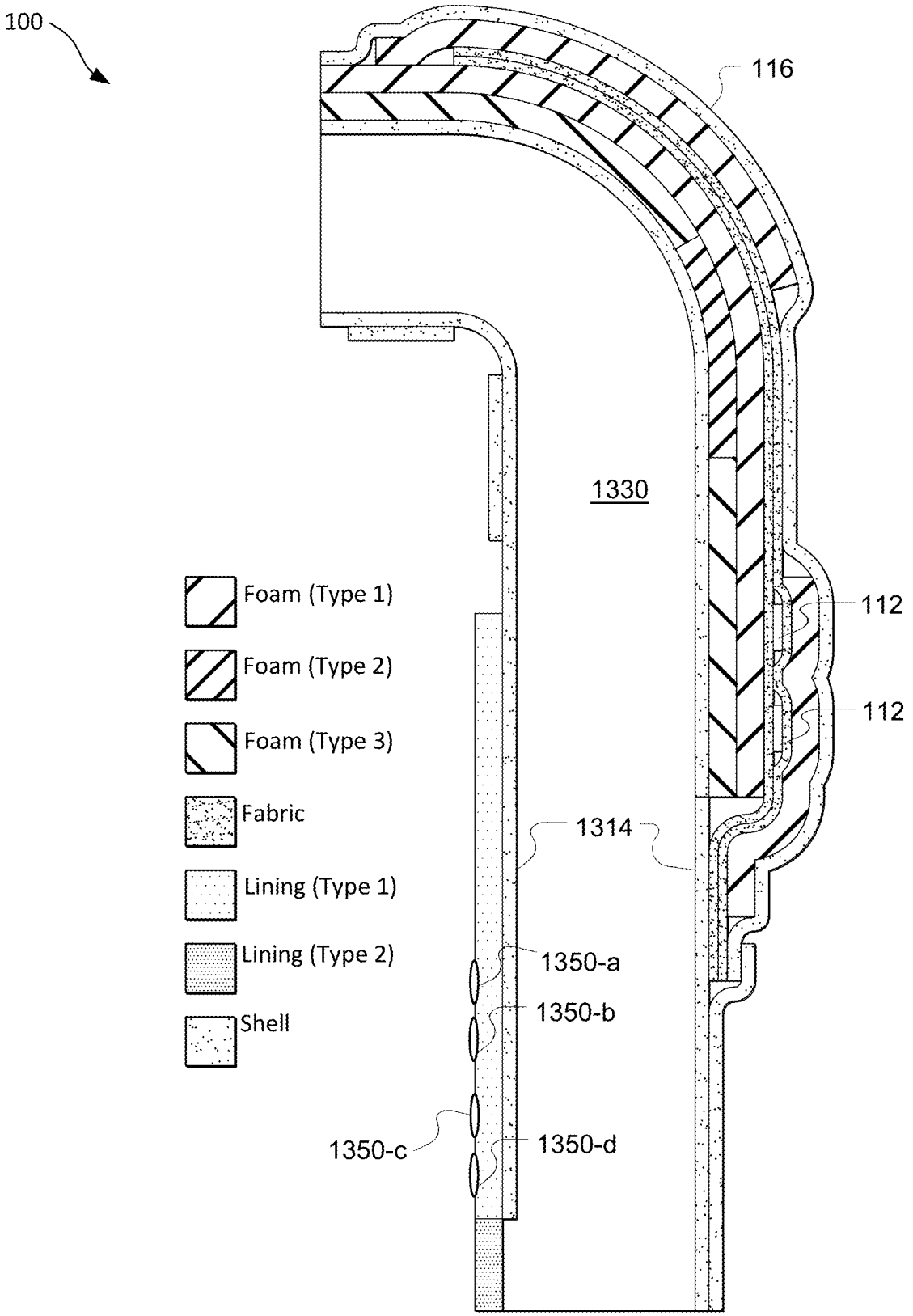
FIG. 13 illustrates a cutaway side view of the striking glove, according to an embodiment of the disclosure.

FIG. 13 illustrates a cutaway side view of an embodiment of the striking glove 100 of the disclosure showing an inner glove 144, the outer shell 116, one or more channels 112 within which straps (not shown) of the internal support system (shown as internal support system 102 in FIG. 1) may be disposed, and one or more padding layers on the palmar and dorsal sides of the striking glove 100. FIG. 13 also illustrates one or more opening holes 1350 (e.g., opening holes 1350-*a*, 1350-*b*, 1350-*c*, and 1350-*d*) on the palmar side of the striking glove 100, through which external ends of the straps of the internal support system extend to an exterior of the striking glove 100. In some cases, the one or more dorsal padding layers may be positioned in a space (e.g., a dorsal cavity) between the inner glove 144 and the outer shell of the striking glove (i.e., on the dorsal side), while the one or more palmar side layers may be positioned on a palmar side of the inner glove 144. It should be noted that, while FIG. 13 depicts the one or more dorsal padding layers as composed of different types of foam, such as Foam (Type 1), Foam (Type 2), Foam (Type 3), these are not intended to be limiting. For instance, in some embodiments, the same type of foam (e.g., Type 1) may be utilized to form the dorsal padding layers. Further, more or less than three foam layers (e.g., on the dorsal side) may be utilized in some embodiments. Some non-limiting examples of materials that may be utilized as the Foam (Type 1), Foam (Type 2), and/or Foam (Type 3) layers may include PORON foam, EVA foam, spongy foam, high density foam, low density foam, and mid-density foam. In some cases, the one or more foam layers may be of the same thickness (e.g., ¼ inch thickness) or a different thickness (e.g., ¼ inch thickness for Foam (Type 1) and ⅛ inch thickness for Foam (Type 2)). Some non-limiting examples of materials that may be used for the fabric layer include canvas, cotton, hemp, linen, etc. In some cases, the one or more foam layers may be similar or substantially similar to the one or more dorsal padding layers previously described in relation to FIGS. 6-10. Further, the one or more fabric layers may be similar or substantially similar to the fabric layers 807 previously described in relation to FIG. 8. In some embodiments, the lining (type 1) on the palmar side may comprise a Neoprene lining, or another applicable material. Further, the lining (type 2) on the palmar side may comprise a Rubber Backed Neoprene (RBN) lining. In some other cases, a single type of lining (e.g., Lining (Type 1) comprising Neoprene) may be used on the palmar side. In some cases, the one or more shell layers (e.g., outer shell layer, inner glove layer) may be composed of leather, such as synthetic leather, composite leather, natural leather, etc., or any other applicable material. For instance, the outer shell 116 may comprise a first type of shell material (e.g., composite leather), while the inner glove 144 may comprise a second type of shell material (e.g., Neoprene or latex).

In some examples, the inner glove 144 may comprise at least one pocket 1330 for receiving the user's hand. Further, the outer shell 116 of the striking glove 100 may be shaped and sized to conform to the inner glove 144. In some embodiments, the inner glove 144 comprises a larger principal pocket (e.g., pocket 1330) for receiving the user's wrist, metacarpals, metacarpal phalangeal joints, and phalanges, and an optional smaller pocket (not shown) for receiving a user's thumb. In some cases, the striking glove 100 may be an example of an open-fingered type glove comprising a plurality of openings, one for each finger. In this way, the glove 100 may be capable of assuming an open position for grappling an opponent and a closed fist position for striking. In some cases, the adjustable internal support system may allow the striking glove 100 to confirm specifically to a particular user's hand size. For instance, the external ends of the straps (e.g., shown as straps 104 in the preceding figures) may exit and extend from a palmar side of the striking glove 100, and may be configured to be pulled in opposite directions to tighten the striking glove 100 (e.g., the internal straps of the striking glove) around the user's hand. In some cases, the internal straps may be arranged in an overlapping and crossed configuration and may serve to compress the bones and soft tissue of the hand and/or wrist. In some aspects, the internal strapping may facilitate in providing a fitted and comfortable glove, where the tight fit may prevent sliding of the user's fist within the glove 100. Furthermore, the internal support system 102 comprising channels 112 and one or more straps disposed within the channels may facilitate in reducing injury to the hand and/or wrist due to a forced compression of the metacarpal bones and/or forced positioning of the wrist. In particular, the tightening of the internal straps may cause the metacarpal bones, especially the most distal (pinky) metacarpal, to be compressed closer together than they would be in their natural fist position. This closer position of the metacarpals reduces the likelihood that a mispositioned blow would isolate the most distal metacarpal and cause injury. Regarding the wrist positioning, the strap tightening (in particular, the pulling of external ends of straps 104) may force the wrist to be angled slightly more proximally to the user's body than its natural position. As a result, the glove 100 may resist ulnar (i.e., towards the pinky finger) directed torsion of the wrist that can result in a wrist sprain or, more detrimentally, a tear to the triangular fibrocartilage complex of the wrist (TFCC). The TFCC is responsible for helping to provide stability between the radius and ulna at the level of the wrist and if torn can sometimes require surgical repair with up to 3-6 months to heal postoperatively.

In some examples, the internal support system may also help position the wrist in such a way as to provide protection from a hyper extension injury. In some circumstances, when the internal straps disposed within channels 112 are tightened, they may force the user's wrist slightly downward, which may serve to reduce the likelihood of the wrist bending backward forcefully, for instance, due to a misplaced blow on the underside of the fist. Extreme, forceful wrist extension can lead to injuries in the wrist including scaphoid fractures, scapholunate ligament injuries, and/or dorsal triquetral avulsion fractures. Treatment for these conditions can range from 4 weeks in a cast to surgery and 6 months of recovery.

Other features of the striking glove 100 aim to decrease injuries to the collateral ligaments by providing a supportive buttress in the center of the hand to limit metacarpal phalangeal (MP) hyperflexion. This buttress is a hand grip, colloquially known as a 'roll of coins'. The hand grip not only helps to decrease hyperflexion of the MP joints, but it also indirectly decreases torsional stress to the MP joint by keeping all the neighbor MP joints and fingers in more anatomic alignment, which may prevent extreme ulnar or radial deviation. In some examples, the striking glove 100 of the present disclosure may further help prevent external ulnar or radial deviation by its angular design in the striking surface. For instance, the internal support system of the striking glove 100 may help line up the radius and ulna bones of the user's arm with the metacarpal and/or carpal bones of the user's hand by pulling the hand slightly downwards (i.e., such that the radius, ulna, metacarpal, and carpal bones are aligned), which may facilitate a true fist position during a strike. In other words, the internal support system may facilitate in the index and long (middle) fingers of making first solid contact during a strike. In some circumstances, currently used open-finger type gloves force the user's hand into a finger poke position by forcing the hand backwards. A user may need to exert extra effort to force the fingers towards a closed fist position, for instance, during striking or while performing grappling maneuvers. The striking glove 100 of the current disclosure alleviates some of these issues by allowing the finger's to be substantially parallel to the ground when in an open fist position, rather than forcing them upward at an angle.

Now turning to FIGS. 14-17, which illustrate the various palmar side layers of the striking glove 100. FIG. 14A illustrates a palmar side view 1400-*a* of a striking glove showing a first palmar layer 1410 and a second palmar layer 1412. As shown by the solid arrow, the first palmar layer 1410 may be shaped and sized to mate (or couple) to the second palmar layer 1412. In some examples, the first and second palmar layers 1410 and 1412 may be stitched, or glued, or affixed by any other applicable means. In some embodiments, the first palmar layer may be formed using a synthetic rubber, such as Neoprene, NEOGREENE provided by GreenSmart of Grass Valley, CA, Lycra, Thermocline, Silicone Rubber, or any other applicable material. Further, second palmar layer 1412 may be formed of the same or different material as first palmar layer 1410. In some cases, first and second palmar layers 1410 and 1412 may have the same or different density, same or different thickness, etc. In one non-limiting example, the second palmar layer 1412 may be composed of Rubber Backed Neoprene (RBN).

Figure 14A:
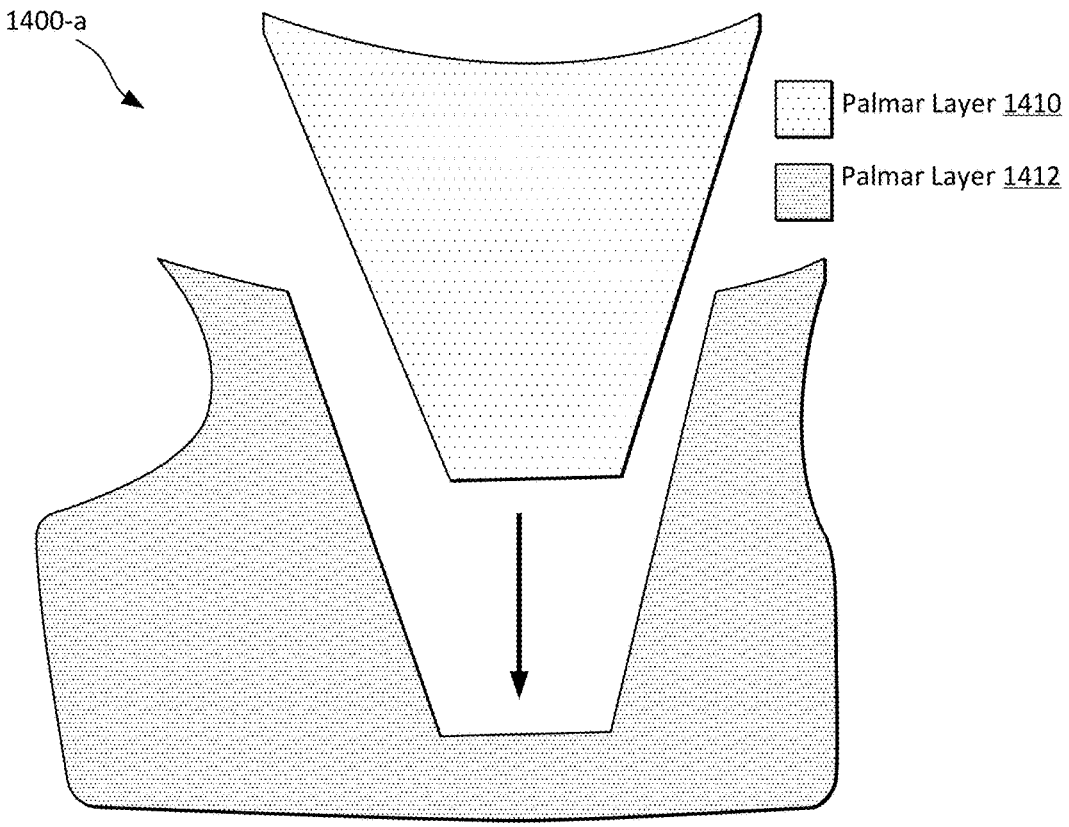
FIG. 14A illustrates a palmar view of the striking glove, according to an embodiment of the disclosure.
Figure 14B:
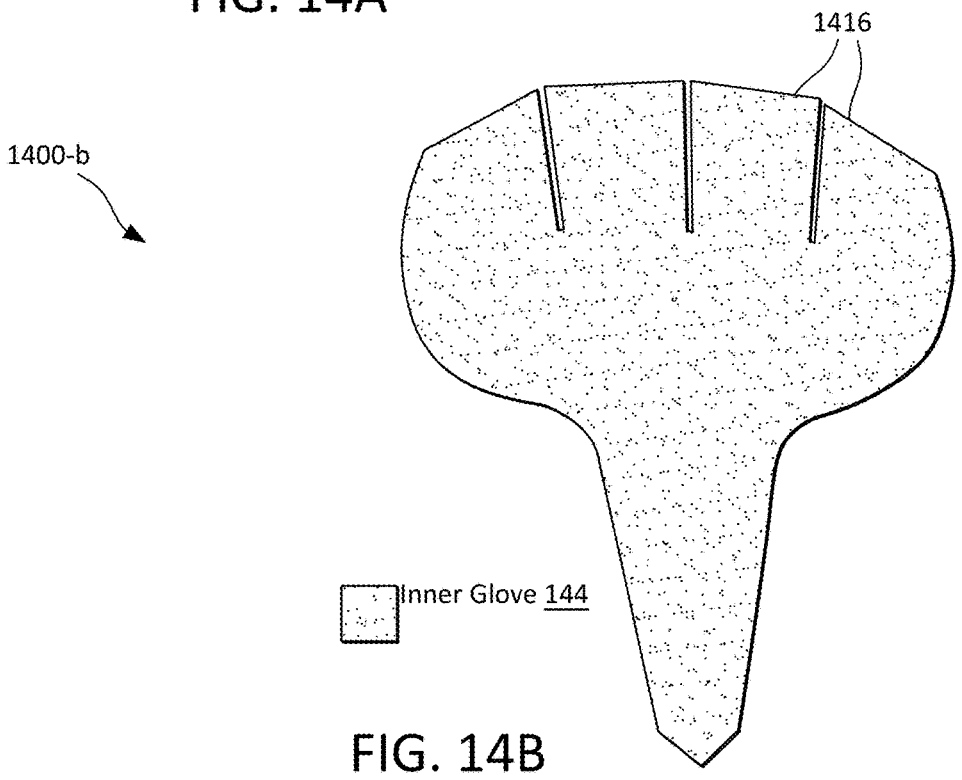
FIG. 14B illustrates a palmar view of the striking glove showing the inner glove, according to an embodiment of the disclosure.

FIG. 14B illustrates a palmar side view 1400-*b* of an inner glove 144. In some examples, the inner glove 144 may be similar or substantially similar to the inner glove 144 previously described in relation to FIG. 13 and/or the inner glove 144 discussed in relation to FIG. 6. In some cases, the inner glove 144 may be configured to receive a user's hand and may comprise a larger principal pocket (e.g., pocket 1330 in FIG. 13) for receiving one or more of the user's wrist, carpals or carpus bones (e.g., lunate, scaphoid, pisiform, triquetral, hamate, trapezoid, capitate, trapezium), metacarpals, carpometacarpal joints between the carpals and the metacarpals, metacarpal phalangeal joints (or metacarpophalangeal joints) between the metacarpals and the phalanges, and phalanges, and an optional smaller pocket (not shown) for receiving a user's thumb. In some cases, each of the phalanges (i.e., fingers) of a user's hand may comprise three distinct bones (i.e., the proximal phalanx closest to the metacarpals, a middle phalanx, and a distal phalanx). In some cases, the striking glove 100 may be an example of an open-fingered type glove comprising a plurality of openings, one for each finger. In some embodiments, at least a portion of the length of each phalanx (e.g., distal phalanx, distal phalanx and a portion of the middle phalanx, etc.) may protrude from an opening of the plurality of openings. In this way, the glove may be capable of assuming an open position for grappling an opponent and a closed fist position for striking. FIG. 14B illustrates four finger pockets 1416, wherein each finger pocket 1416 is configured to receive one finger (e.g., index, middle, ring, and pinky) of a user's hand. While not shown, in some examples, each finger pocket 1416 may terminate in an opening (e.g., on the distal end) from which a respective finger may protrude to an exterior of the striking glove. In some embodiments, the inner glove 144 may be composed of leather (e.g., composite leather, synthetic leather), neoprene, or any other applicable material. Additionally or alternatively, the inner glove 144 may be formed using the same material used to form the outer shell (e.g., shown as outer shell 116 in FIG. 1) of the striking glove. In some embodiments, the inner glove 144 may be configured to be removable from the striking glove 100, for instance, during cleaning.

Figure 15:
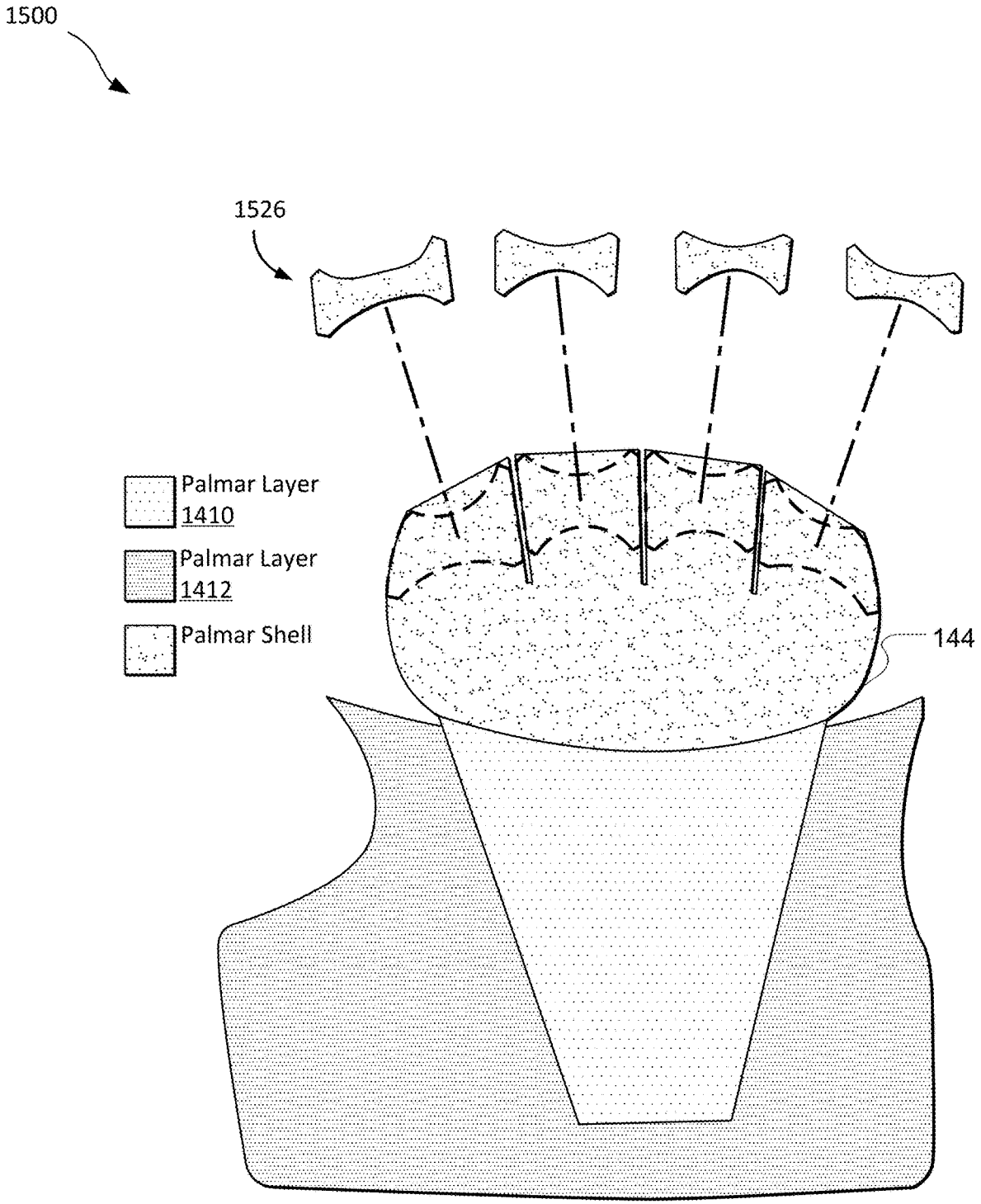
FIG. 15 illustrates a palmar view of the striking glove, according to an embodiment of the disclosure.

FIG. 15 illustrates a palmar side view 1500 of an embodiment of the striking glove of the present disclosure. FIG. 15 illustrates the first palmar layer 1410, the second palmar layer 1412, and a palmar shell comprising the inner glove 144 and one or more third palmar layers 1526 stitched on a palmar side of the inner glove 144. In some cases, each of the one or more third palmar layers 1526 may be shaped and sized to overlap with a base of a proximal phalanx (i.e., base of a finger) of the user's hand. FIG. 15 shows four third palmar layers 1526, one for each of the index (pointer), middle, ring, and pinky fingers. In some cases, the third palmar layers 1526 may be composed of a similar or substantially material to the inner glove 144, such as leather or composite leather. In some embodiments, the third palmar layers 1526 may be unitary in construction with the inner glove 144. In other cases, the third palmar layers 1526 may be composed of a different material. In some examples, the third palmar layers 1526 and the inner glove 144 may be formed of a flexible and/or sturdy material configured to withstand numerous extension and contraction cycles (i.e., between an open and closed fist position). In some embodiments, the inner glove 144 and palmar layers 1526 may also be water-proof and/or cleanable.

Figure 16:
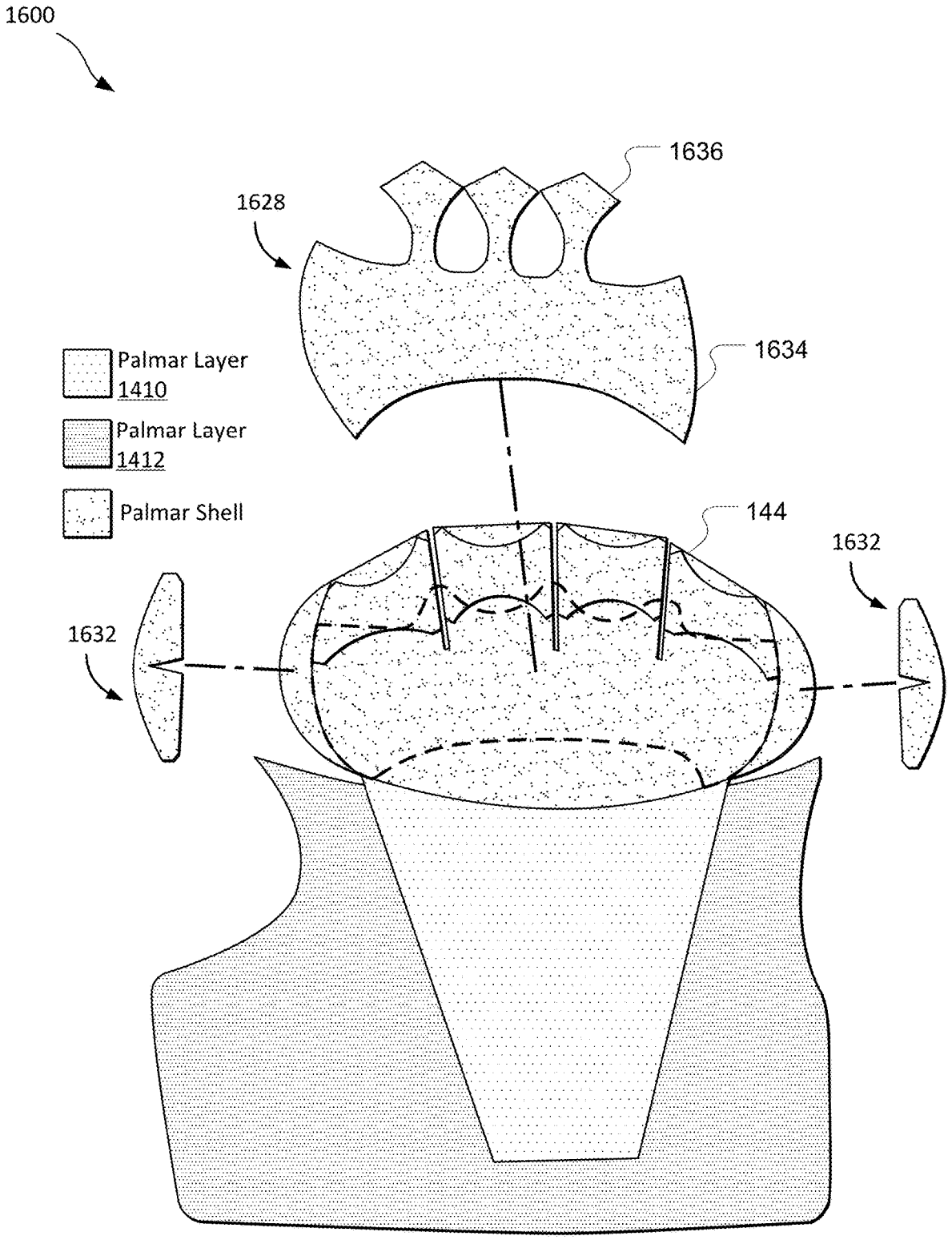
FIG. 16 illustrates a palmar view of the striking glove, according to an embodiment of the disclosure.

FIG. 16 illustrates a palmar side view 1600 of an embodiment of the striking glove of the present disclosure. FIG. 16 illustrates the first palmar layer 1410, the second palmar layer 1412, and a palmar shell, wherein the palmar shell comprises the inner glove 144, the one or more third palmar layers (e.g., third palmar layers 1526 in FIG. 15), a medial palm layer 1628, and one or more lateral palm layers 1632 positioned on a palmar side of the striking glove, for instance, on a palmar side of the inner glove 144. In some cases, the medial palm layer 1628 and the one or more lateral palm layers 1632 may be shaped and sized to overlap the metacarpal bones, and at least a portion of the phalanges (e.g., one or more proximal phalanxes) on the palmar side. In some cases, the medial and lateral palm layers 1628 and 1632, respectively, may be composed of the same or similar material as the inner glove 144. While shown as separate and distinct layers, it should be noted that the medial palm layer 1628, lateral palm layer 1632, and the one or more third palmar layers 1526 may be formed as a unitary construction with the inner glove 144. In other cases, they may be stitched on to the palmar side of the inner glove 144. As shown, the medial palmar layer 1628 may comprise a base 1634 and one or more phalanx portions 1636. In some embodiments, each phalanx portion 1636 may be configured to align with one of the index (pointer), middle, and ring fingers (e.g., with proximal phalanxes of the respective fingers). The number of phalanx portions 1636 is not intended to be limiting, and more or less than three phalanx portions 1636 may be utilized in some embodiments. In some cases, the medial palmar layer 1628 may be composed of leather, such as synthetic leather or composite leather, or any other applicable material. In some cases, the base 1634 of the medial palmar layer 1628 may be configured to conform to at least a portion of the palm of the user's hand (e.g., the base 1634 may span a majority of the width of the user's palm and overlap a portion of the metacarpal bones, metacarpophalangeal joints, and/or the phalanges).

Figure 17:
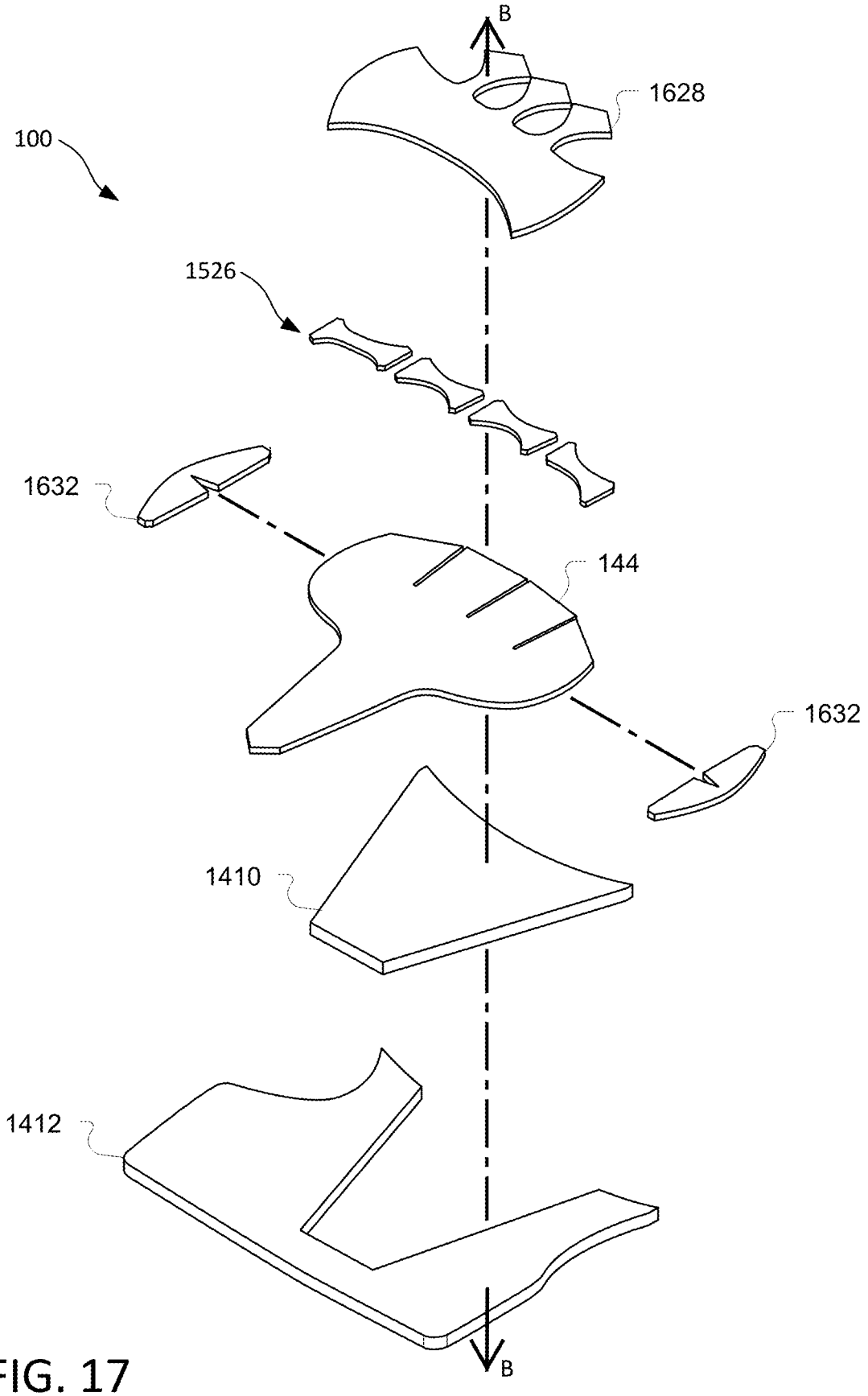
FIG. 17 illustrates an exploded view of the palmar side of the striking glove, according to an embodiment of the disclosure.

FIG. 17 illustrates an exploded view of the palmar side of the striking glove 100 showing the one or more palmar side layers (e.g., first palmar layer 1410, second palmar layer 1412, third palmar layers 1526, medial palmar layer 1628, one or more lateral palmar layers 1632) and the inner glove 144, previously described in relation to FIGS. 13-16.

In some embodiments, the striking glove of the present disclosure may be particularly suited for MMA fighting, as opposed to boxing. In certain MMA sports, such as UFC®, it is customary or required that a glove have open fingers. Such a glove may have individual pockets for each finger and the thumb and may terminate in openings near the phalangeal knuckles. Striking gloves of these particular embodiments may have less padding, or padding of a different density (e.g., than that in boxing glove embodiments). The internal support system features and functions may remain substantially similar. These embodiments may not necessarily include an inner glove (e.g., inner glove 144) and an outer shell (e.g., outer shell 116) with a dorsal cavity between. Instead, the straps 104 of this particular embodiment may be retained in channels 112 formed by stitching fabric to an exterior of the dorsal side of the glove, as described above in relation to FIGS. 8 and/or 13. For example, a piece of fabric having an overlapped or crossed pattern may be stitched to the dorsal side of the glove, and the cavity may be defined by the piece of fabric and the dorsal surface of the glove. In such cases, the straps may be retained and configured to slide within the channels.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A striking glove comprising:

a dorsal side and a palmar side;

a wrist band; an inner glove configured to receive a hand;

an outer shell conforming generally to the inner glove and defining therebetween a space;

one or more padding layers positioned in the space between the inner glove and the outer shell;

an internal support system between a first padding layer of the one or more padding layers and the outer shell, the internal support system comprising at least a first channel and a second channel disposed on the dorsal side of the glove;

wherein the internal support system further comprises at least a first strap and a second strap at least partially disposed within the first and second channels and configured in an overlapped and crossed configuration, wherein each of the first and the second strap is configured to be retained within and slide within the respective channel, and wherein ends of the first and second straps extend from a dorsal cavity between the inner glove and the outer shell to an exterior of the striking glove;

wherein the internal support system further comprises at least a third strap having at least one branched portion overlapping or crossing at least one of the first strap and/or the second strap; and wherein the first strap, the second strap, and the at least third strap are independently movable.

2. The striking glove of claim 1, wherein the internal support system is configured to:

separate knuckles from tendons of flexor digitorum superficialis in the hand during impact, and support number 2, 3, 4, and 5 metacarpal bones in the hand during impact.

3. The striking glove of claim 2, wherein the first strap is secured at an internal end between a first finger cavity and a second finger cavity of the striking glove, and wherein the second strap is secured at an internal end between a third finger cavity and a fourth finger cavity of the striking glove.

4. The striking glove of claim 3, wherein the internal support system further comprises:

the third strap disposed within a third channel in the dorsal cavity, the third strap comprising a vertical portion secured at an internal end between the second finger cavity and the third finger cavity, and the at least one branched portion extending from the vertical portion to the exterior of the striking glove.

5. The striking glove of claim 4, wherein the at least one branched portion comprises two branch straps, each branch strap having an external end extending from the dorsal cavity to the exterior of the striking glove, and wherein a first branch strap of the two branch straps overlaps or crosses the first strap, and wherein a second branch strap of the two branch straps overlaps or crosses the second strap.

6. The striking glove of claim 5, wherein the internal support system is configured to:

provide vertical support to a plurality of metacarpal bones and a plurality of ligaments connected to the plurality of metacarpal bones in the hand, wherein the vertical support is oriented in a direction that extends from the knuckles to the wrist of the hand, and wherein the plurality of metacarpal bones comprise the 2, 3, 4, and 5 metacarpal bones; and separate and support a plurality of flexor tendons of a plurality of fingers of the hand, based at least in part on providing the vertical support to the plurality of metacarpal bones and the plurality of ligaments.

7. The striking glove of claim 5, wherein external ends of the first strap, the second strap, and the first and second branch straps are configured to extend from opening holes in the outer shell at the palmar side to the exterior of the striking glove.

8. The striking glove of claim 1, further comprising at least two openings in the outer shell on the palmar side to allow external ends of the first strap and the second strap to extend from the dorsal cavity to the exterior of the striking glove.

9. The striking glove of claim 1, wherein the first strap and the second strap cross on the dorsal side, wherein each of the first strap and the second strap terminate in laces, and wherein respective laces of the first and the second strap cross on the palmar side.

10. The striking glove of claim 1, wherein the one or more padding layers comprise one or more dorsal padding layers secured between the inner glove and the outer shell, wherein the one or more dorsal padding layers are configured to provide impact protection to dorsal surfaces of one or more of the wrist, metacarpals, metacarpal phalangeal joints, and phalanges.

11. The striking glove of claim 1, wherein the one or more dorsal padding layers comprise one or more foam layers, each of the one or more foam layers selected from a group consisting of a spongy foam layer, a PORON foam layer, an Ethylene-Vinyl Acetate (EVA) foam layer, a low density foam layer, a high density foam layer, and a mixed density foam layer.

12. The striking glove of claim 1, further comprising one or more lateral knuckle padding layers configured to wrap around lateral parts of knuckles and provide protection to number 2 and number 5 metacarpal knuckles during striking.

13. The striking glove of claim 1, wherein the striking glove is capable of assuming an open position for grappling and a clenched first position for striking, and wherein the internal support system is configured to force the hand towards the clenched first position.

14. The striking glove of claim 1, wherein the striking glove is an open-fingered type glove comprising one or more finger cavities.

15. A striking glove comprising:

a dorsal side and a palmar side;

a wrist band;

an inner glove configured to receive a hand;

an outer shell conforming generally to the inner glove and defining therebetween a space;

a plurality of finger cavities;

an internal support system disposed underneath the outer shell, the internal support system comprising at least:

a first strap and a second strap; and a third strap having a vertical portion and a branched portion, wherein the branched portion overlaps or crosses at least one of the first strap and/or the second strap;

wherein each of the first strap, the second strap, and the vertical portion of the third strap is secured at an internal end between adjacent finger cavities of the plurality of finger cavities;

wherein the first strap, the second strap, and the third strap are independently movable; and wherein the internal support system is configured to one or more of:

provide support to a plurality of metacarpal bones in the hand, provide support to a plurality of ligaments in the hand, and separate and support a plurality of flexor tendons of a plurality of fingers of the hand.

16. The striking glove of claim 15, wherein the first strap is secured at an internal end between a first finger cavity and a second finger cavity of the plurality of finger cavities, the second strap is secured at an internal end between a third finger cavity and a fourth finger cavity of the plurality of finger cavities, and the vertical portion of the third strap is secured at an internal end between the second finger cavity and the third finger cavity of the plurality of finger cavities.

17. The striking glove of claim 15, wherein the branched portion comprises a first branch strap and a second branch strap, wherein the first branch strap overlaps or crosses the first strap, and wherein the second branch strap overlaps or crosses the second strap, and wherein the first and the second branch straps are independently movable.

18. The striking glove of claim 17, further comprising:

a dorsal cavity between the inner glove and the outer shell;

one or more lateral knuckle padding layers configured to wrap around lateral parts of knuckles and provide protection to number 2 and number 5 metacarpal knuckles during striking; and one or more dorsal padding layers positioned in a space between the inner glove and the outer shell; and wherein an external end of each of the first strap, the second strap, the first branch strap, and the second branch strap extend from the dorsal cavity to an exterior of the striking glove.

19. The striking glove of claim 18, wherein:

the one or more dorsal padding layers are secured between the inner glove and the outer shell; and the one or more dorsal padding layers are configured to provide impact protection to dorsal surfaces of one or more of the wrist, metacarpals, metacarpal phalangeal joints, and phalanges.

20. The striking glove of claim 15, wherein the internal support system is at least partially disposed on the dorsal side of the inner glove, and wherein the internal support system further comprises:

a plurality of channels, including at least a first channel, a second channel, and a third channel;

wherein the first strap is at least partially disposed within the first channel, wherein the second strap is at least partially disposed within the second channel, and wherein the third strap is at least partially disposed within the third channel.

* * * * *